US011844426B1

(12) United States Patent
Moore

(10) Patent No.: US 11,844,426 B1
(45) Date of Patent: Dec. 19, 2023

(54) DESK WITH AN UPRIGHT PARTITION ON A WORK SURFACE THAT SUPPORTS LATERALLY-MOVABLE ATTACHMENTS

(71) Applicant: Mateo Goods Co., Tempe, AZ (US)

(72) Inventor: Matthew Jason Moore, Phoenix, AZ (US)

(73) Assignee: Mateo Goods Co., Tempe, AZ (US)

( * ) Notice: Subject to any disclaimer, the term of this patent is extended or adjusted under 35 U.S.C. 154(b) by 77 days.

(21) Appl. No.: 17/532,295

(22) Filed: Nov. 22, 2021

(51) Int. Cl.
*A47B 21/02* (2006.01)
*A47B 9/00* (2006.01)

(52) U.S. Cl.
CPC ..... *A47B 21/02* (2013.01); *A47B 9/00* (2013.01); *A47B 2200/0075* (2013.01); *A47B 2200/12* (2013.01); *A47B 2220/0091* (2013.01)

(58) Field of Classification Search
CPC .. A47B 9/20; A47B 9/00; A47B 21/02; A47B 21/04; A47B 2200/0058; A47B 2200/0062; A47B 2200/0084; A47B 2200/0075; A47B 2200/12; A47B 57/00; A47F 5/005
USPC ..... 108/180, 50.01, 157.14, 60
See application file for complete search history.

(56) References Cited

U.S. PATENT DOCUMENTS

D128,791 S 8/1941 Ullery
2,560,957 A 7/1951 Johnson
D164,584 S 9/1951 Koegel
2,636,224 A 4/1953 Murdoch
3,113,531 A 12/1963 Barnard
3,285,424 A * 11/1966 Emery ..... A47F 7/145 211/184
D208,256 S 8/1967 Rich
D216,204 S 12/1969 Hess
D243,192 S 1/1977 Clayton
(Continued)

FOREIGN PATENT DOCUMENTS

CA 2348060 11/2002
CA 2840843 12/2013
(Continued)

OTHER PUBLICATIONS

The Sit Desk by Mateo Goods, first available: Unknown. hellomateogoods.com [online], [site visited Apr. 13, 2022], Internet URL: https://hellomateogoods.com/collections/all/products/the-static-desk (Year: 2022).

(Continued)

*Primary Examiner* — Jose V Chen
(74) *Attorney, Agent, or Firm* — ESPLIN & ASSOCIATES, PC

(57) ABSTRACT

A desk with an upright partition is disclosed. The upright partition connects to the work surface of the desk. The upright partition is configured to support laterally-movable attachments. Exemplary implementations may include one or more of a work surface, a left-side support structure, a right-side support structure, a core body, a working body that provides the work surface, an upright partition that supports laterally-movable attachments, one or more laterally-movable attachments, and/or other components. The one or more laterally-movable attachments can be mechanically coupled to the upright partition and are supported by the upright partition.

9 Claims, 27 Drawing Sheets

(56) References Cited

U.S. PATENT DOCUMENTS

| | | | | |
|---|---|---|---|---|
| D243,300 | S | 2/1977 | Christensen | |
| D258,789 | S | 4/1981 | Verdesca | |
| D260,716 | S | 9/1981 | Cohen | |
| D261,713 | S | 11/1981 | Curatolo | |
| D262,763 | S | 1/1982 | Lerner | |
| D262,846 | S | 2/1982 | Chaiken | |
| D267,690 | S | 1/1983 | Verdesca | |
| D278,583 | S | 4/1985 | Koguma | |
| D282,023 | S | 1/1986 | Sottsass | |
| D285,394 | S | 9/1986 | Curran | |
| D286,832 | S | 11/1986 | Matthews | |
| 4,651,652 | A | 3/1987 | Wyckoff | |
| 4,668,026 | A | 5/1987 | Lapeyre | |
| D297,987 | S | 10/1988 | Borsos | |
| 4,790,611 | A | 12/1988 | Craner | |
| D305,585 | S | 1/1990 | Wright | |
| D305,838 | S | 2/1990 | Bienenstock | |
| 4,969,403 | A | 11/1990 | Schwartz | |
| 4,987,835 | A | 1/1991 | Schwartz | |
| D314,289 | S | 2/1991 | Schaelling | |
| 5,083,514 | A | 1/1992 | Schwartz | |
| D330,469 | S | 10/1992 | Brodbeck | |
| D340,816 | S | 11/1993 | Lee | |
| D345,062 | S | 3/1994 | Brandon | |
| 5,322,025 | A | 6/1994 | Sherman | |
| 5,363,775 | A | 11/1994 | Simpson | |
| D368,812 | S | 4/1996 | Lee | |
| 5,544,593 | A | 8/1996 | Canfield | |
| 5,568,773 | A * | 10/1996 | Hung | A47B 21/0314 108/50.01 |
| 5,720,185 | A | 2/1998 | Lee | |
| D393,958 | S | 5/1998 | Moncourtois | |
| 5,791,265 | A | 8/1998 | Ellsworth | |
| D399,683 | S | 10/1998 | Nicklas | |
| 6,070,956 | A | 6/2000 | Yates | |
| 6,202,567 | B1 * | 3/2001 | Funk | A47B 21/06 108/50.01 |
| 6,220,180 | B1 * | 4/2001 | Janowitz | A47B 21/00 108/50.01 |
| D441,566 | S | 5/2001 | Martin | |
| 6,286,441 | B1 | 9/2001 | Burdi | |
| 6,398,326 | B1 | 6/2002 | Wang | |
| D473,728 | S | 4/2003 | Chang | |
| 6,708,627 | B1 | 3/2004 | Wood | |
| D489,200 | S | 5/2004 | Antonioni | |
| D496,183 | S | 9/2004 | Savage | |
| 6,796,247 | B1 | 9/2004 | Iglseder | |
| D516,340 | S | 3/2006 | Chang | |
| D538,068 | S | 3/2007 | Newhouse | |
| D546,103 | S | 7/2007 | Eyman | |
| D552,900 | S | 10/2007 | Wilenius | |
| 7,331,296 | B1 | 2/2008 | Wood | |
| 7,398,738 | B2 | 7/2008 | Newhouse | |
| D596,876 | S | 7/2009 | Oshinomi | |
| D610,840 | S | 3/2010 | Kato | |
| 7,789,251 | B1 | 9/2010 | Clark | |
| 7,866,622 | B2 | 1/2011 | Dittmer | |
| 7,975,626 | B1 | 7/2011 | Wang | |
| D647,324 | S | 10/2011 | Kincaid | |
| D653,862 | S | 2/2012 | Hairston | |
| 8,196,526 | B2 * | 6/2012 | Rheault | A47B 21/06 108/50.01 |
| D677,943 | S | 3/2013 | Mendoza | |
| D724,364 | S | 3/2015 | Demars | |
| 8,985,032 | B1 | 3/2015 | Johnson | |
| D730,658 | S | 6/2015 | Dillon | |
| 9,277,806 | B2 | 3/2016 | Hallman | |
| D761,577 | S | 7/2016 | Agati | |
| D773,219 | S | 12/2016 | Clouse | |
| 9,593,481 | B2 | 3/2017 | Gosling | |
| 9,661,923 | B2 * | 5/2017 | Lanphear | A47B 83/04 |
| D788,496 | S | 6/2017 | Yamamoto | |
| 9,723,919 | B1 | 8/2017 | Randolph | |
| 9,980,559 | B2 | 5/2018 | Randolph | |
| 10,034,538 | B1 | 7/2018 | Masters | |
| 10,117,511 | B2 * | 11/2018 | Gosling | A47B 83/001 |
| D853,759 | S | 7/2019 | Moore | |
| D863,833 | S | 10/2019 | Moore | |
| 10,561,233 | B1 | 2/2020 | Lin | |
| 10,939,752 | B2 | 3/2021 | Moore | |
| 11,589,673 | B1 * | 2/2023 | Moore | A47B 9/00 |
| 11,617,433 | B1 | 4/2023 | Moore | |
| 2002/0050234 | A1 | 5/2002 | Lechman | |
| 2004/0123782 | A1 | 7/2004 | Korber | |
| 2004/0173125 | A1 | 9/2004 | Chang | |
| 2004/0237852 | A1 | 12/2004 | Tsai | |
| 2005/0016080 | A1 | 1/2005 | Williams | |
| 2006/0185564 | A1 | 8/2006 | Stengel | |
| 2006/0230992 | A1 | 10/2006 | Newhouse | |
| 2007/0044692 | A1 | 3/2007 | Zimmer | |
| 2008/0018211 | A1 | 1/2008 | Dye | |
| 2008/0284292 | A1 | 11/2008 | Castelluccio | |
| 2008/0284293 | A1 | 11/2008 | Martin | |
| 2009/0094913 | A1 | 4/2009 | Singh | |
| 2016/0128469 | A1 | 5/2016 | Matthai | |
| 2016/0260019 | A1 | 9/2016 | Riquelme Ruiz | |
| 2016/0353876 | A1 | 12/2016 | Mitchell | |
| 2016/0360879 | A1 | 12/2016 | Kelley | |
| 2017/0251806 | A1 | 9/2017 | Newman | |
| 2018/0168334 | A1 | 6/2018 | Swartz | |
| 2018/0360207 | A1 | 12/2018 | Neudeck | |
| 2019/0023298 | A1 | 1/2019 | Carzola | |
| 2019/0125075 | A1 | 5/2019 | Soulliere | |
| 2019/0223586 | A1 | 7/2019 | Hansen | |
| 2019/0374023 | A1 | 12/2019 | Allen | |
| 2020/0178683 | A1 | 6/2020 | O'Gara | |
| 2020/0329860 | A1 | 10/2020 | Xiang | |
| 2020/0329861 | A1 | 10/2020 | Zhang | |
| 2020/0383501 | A1 * | 12/2020 | Udagawa | E06B 9/24 |
| 2021/0011453 | A1 | 1/2021 | Xiang | |
| 2021/0386193 | A1 * | 12/2021 | Bucquet | A47C 31/126 |
| 2022/0031062 | A1 | 2/2022 | Albert | |
| 2022/0218102 | A1 | 7/2022 | Isgar | |
| 2023/0218077 | A1 | 7/2023 | Moore | |
| 2023/0218078 | A1 | 7/2023 | Moore | |

FOREIGN PATENT DOCUMENTS

| | | |
|---|---|---|
| GB | 2362822 | 12/2001 |
| WO | 2016195853 | 12/2016 |

OTHER PUBLICATIONS

All Sit / Sitstand Desks by Mateo Goods, first available: Unknown. hellomateogoods.com [online], [site visited Apr. 13, 2022], Internet URL: https://hellomateogoods.com/collections/all (Year: 2022).

The Sit-Stand Desk by Mateo Goods, first available: Sep. 26, 2020. Indiegogo.com [online], [site visited Apr. 13, 2022], Internet URL:https://www.indiegogo.com/projects/the-sit-stand-desk-by-mateo#/ (Year:: 2020).

* cited by examiner

DESK WITH AN UPRIGHT PARTITION ON A WORK SURFACE THAT SUPPORTS LATERALLY-MOVABLE ATTACHMENTS

FIELD OF THE DISCLOSURE

The present disclosure relates to a desk with an upright partition that supports laterally-movable attachments.

BACKGROUND

Desks are known, typically as work surfaces for people at a fixed height. Cubicles are known as work areas, typically for people working at desks. Height-adjustable desks are known.

SUMMARY

One aspect of the present disclosure relates to a desk with an upright partition that supports laterally-movable attachments. In some cases, the desk may be configured to be positioned for a person (i.e., a user) in a sitting and/or standing position. As used herein, relative positional terms including but not limited to rear side, front side, left side and right side may refer to the point of view of a user positioned at the desk in a common fashion. The desk may include one or more of a work surface, a left-side support structure, a right-side support structure, a core body, a working body that provides the work surface, one or more modular attachments, one or more mounting brackets, and/or other components. Some components of the desk, including the one or more modular attachments, may have no direct contact with the ground and may be supported by one or more support structures. As described by the present disclosure, the desk may provide different improvements and/or advantages, including but not limited to a flexible and adjustable configuration of different components.

As used herein, any association (or relation, or reflection, or indication, or correspondency) involving desk parts, surfaces, support structures, bodies, attachments, openings, cavities, stiles, actuators, motors, columns, arms, housings, couplings, interfaces, buttons, and/or another entity or object that interacts with any part of the desk, may be a one-to-one association, a one-to-many association, a many-to-one association, and/or many-to-many association or "N"-to-"M" association (note that "N" and "M" may be different numbers greater than 1).

As used herein, the term "detect" (and derivatives thereof) may include active determination, realization, and conclusion of user input, and/or any combination thereof. As used herein, the term "control" (and derivatives thereof) may include active and/or passive effectuation, and causation of a response to user input, and/or any combination thereof. As used herein, the term "adjustably coupled" (and derivatives thereof) may include temporary and/or permanent fastening, joining, assembling, combining, and/or uniting of desk parts, and/or any combination thereof.

These and other features and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1A:
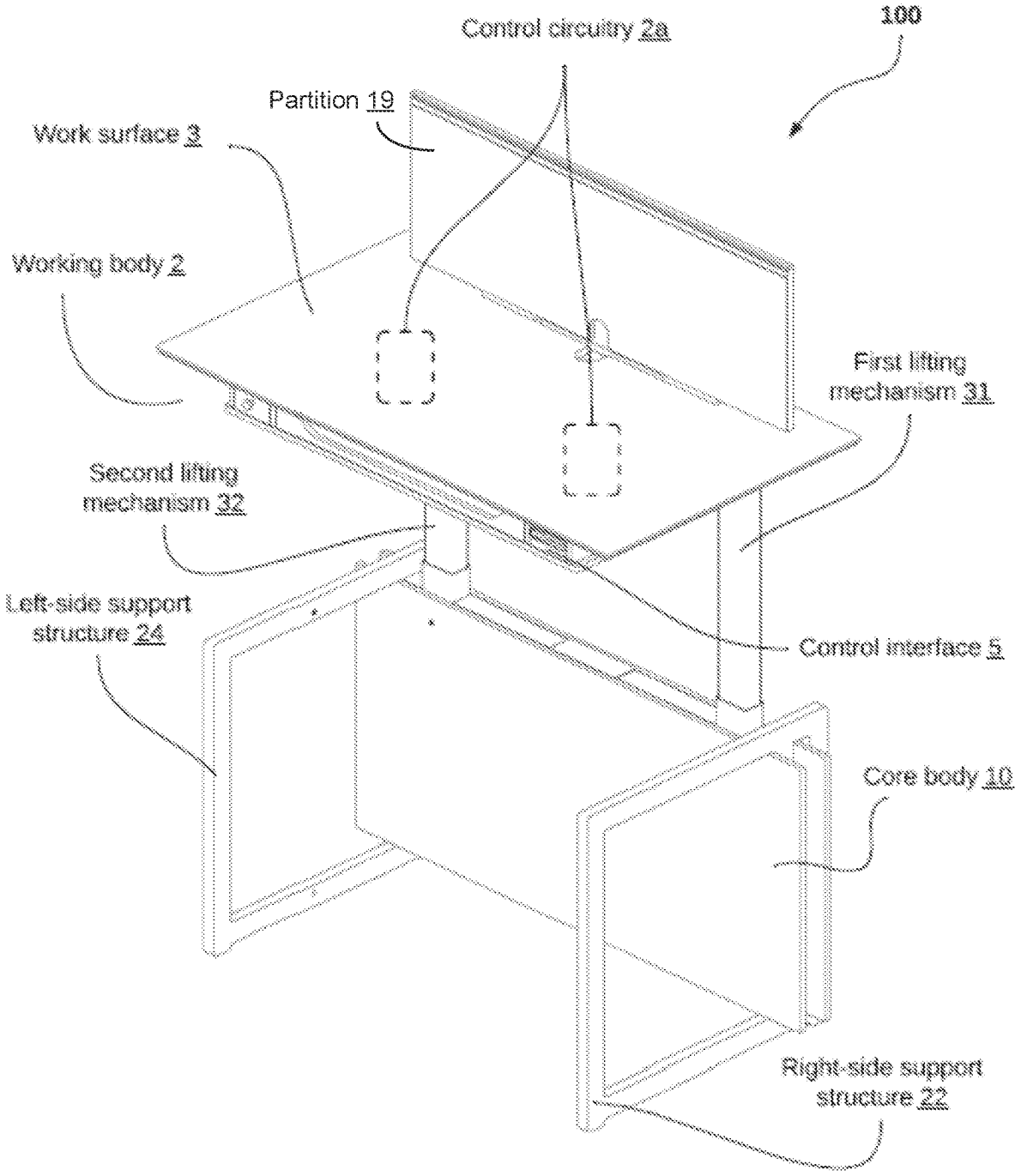
FIG. 1A shows an assembled view of a desk, in accordance with one or more implementations.

FIG. 1A shows a desk 100 with support structures (i.e., a left-side support structure 24 on the left side of desk 100 and a right-side support structure 22 on the right side of desk 100 as viewed by a user and as depicted in FIG. 1A) and an upright partition 19 configured to support laterally-movable attachments, in accordance with one or more implementations. In some implementations, support structures may be referred to as "legs". In some implementations, the support structures of desk 100 may be configured to support modular attachments. The modular attachments can be attached on either the left side or the right side of desk 100, or on both sides at the same time. In some implementations, modular attachments may be attached either outside the support structures, between the support structures, or both. While attached, in some implementations, the modular attachments may be supported (in part, or entirely) by the support structures. By way of non-limiting example, FIGS. 1F-1G-1H show desk 100 and upright partition 19, and show, attached to upright partition 19, different laterally-movable attachments such as attachment 19*c*, attachment 19*d*, and attachment 19*d*, respectively. Modular attachment 15 may be configured to provide extended functionality to the user of desk 100, as described in this disclosure.

Referring to FIG. 1, in some implementations, desk 100 may be configured to be positioned for a user in a sitting position and/or standing position. FIG. 1A shows desk 100 in a standing and/or lifted position. Desk 100 may include one or more of a working body 2, a control circuitry 2*a*, a work surface 3, upright partition 19, a control interface 5, a core body 10, left-side support structure 24, right-side support structure 22, a first lifting mechanism 31, a second lifting mechanism 32, and/or other components. Desk 100 may further include one or more modular attachments 15 (e.g., see FIG. 6 and FIG. 8), one or more mounting brackets 16 (e.g., see FIG. 6 and FIG. 8, these are depicted as dotted rectangles to indicate these components may be embedded within desk 100, and/or otherwise not readily visible from a particular viewing angle), one or more laterally-movable attachments (e.g., see FIGS. 1F-1G-1H, as well as FIGS. 13A-13B and 14A-14B), and/or other components.

Left-side support structure 24 and right-side support structure 22 may be configured to be coupled to core body 10 to provide the entire desk stability while being raised, lowered, and/or in use. First lifting mechanism 31 and second lifting mechanism 32 may be coupled to core body 10 and working body 2. By way of non-limiting example, other components may be configured and/or customized for the desk as preferred by the users.

Figure 1B:
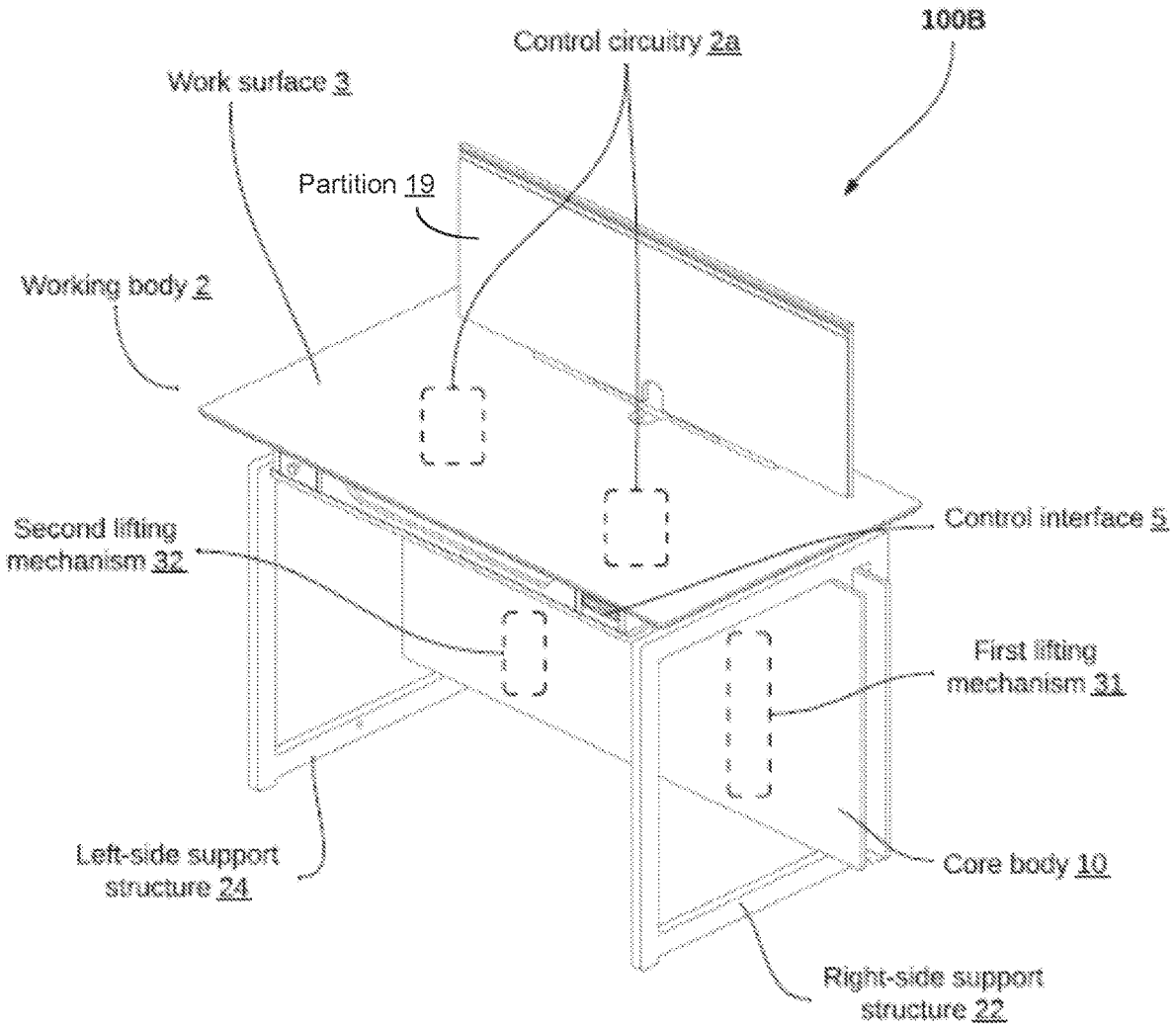
FIG. 1B shows an assembled view of a desk, in accordance with one or more implementations.

FIG. 1B shows a perspective elevated view 100B of a height-adjustable desk in a sitting and/or lowered position. In this position, first lifting mechanism 31 and second lifting mechanism 32 may be (at least partially) housed within core body 10. In some implementations, in this position, first lifting mechanism 31 and second lifting mechanism 32 may be mostly hidden from view.

Figure 1C:
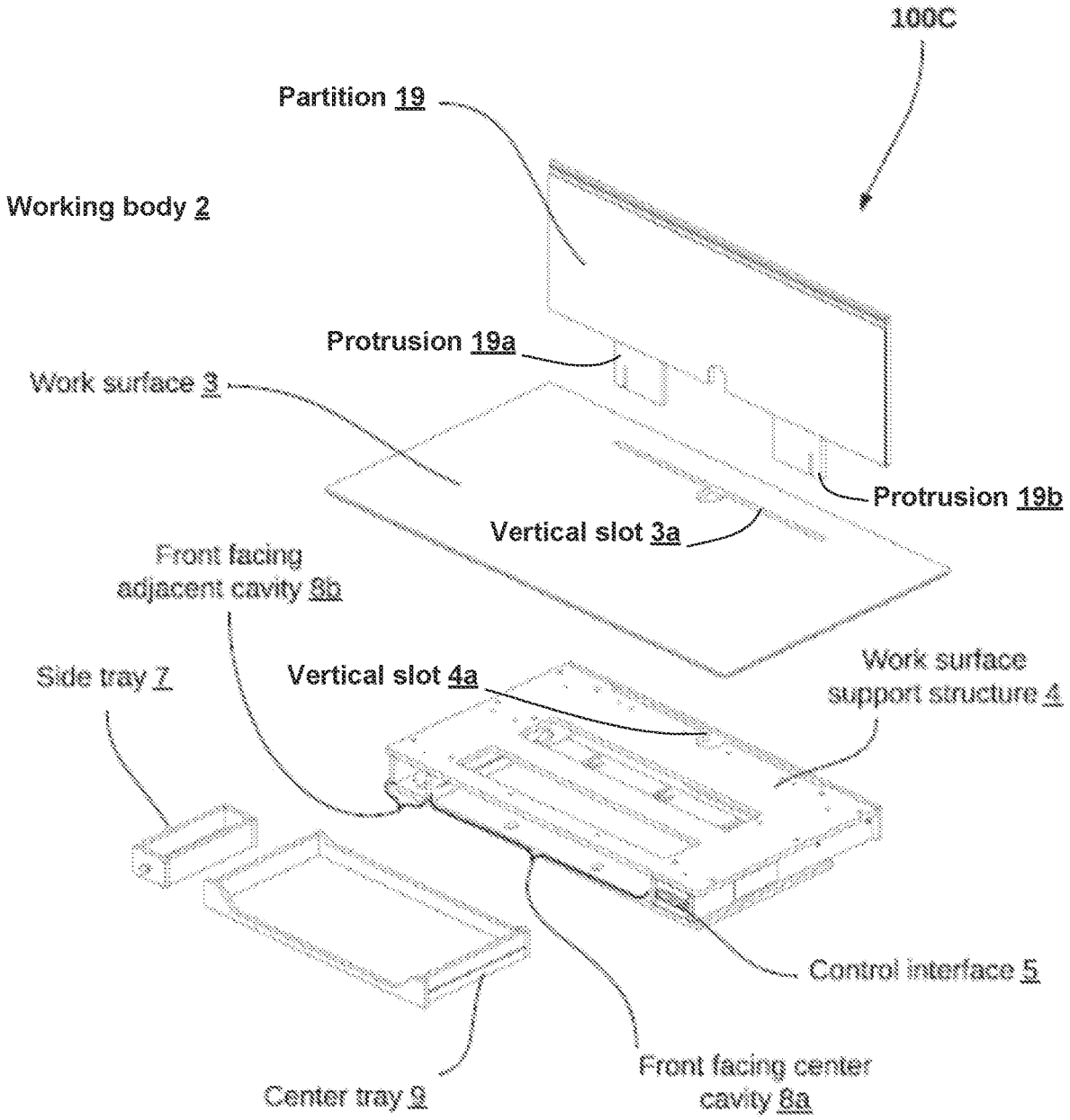
FIG. 1C shows a disassembled and/or exploded view of a working body of a desk, in accordance with one or more implementations.

Working body 2 may be configured to include a work surface 3 coupled to a work surface support structure 4 as shown in FIG. 1C, as well as an upright partition 19 coupled to work surface 3 as depicted. Working body 2 may be configured to adjustably couple to first lifting mechanism 31 (FIG. 1A) and second lifting mechanism 32 (FIG. 1A). Working body 2 may be configured to be supported by core body 10 at a rear side of desk 100 by virtue of core body 10 being coupled to first lifting mechanism 31 (FIG. 1A), second lifting mechanism 32 (FIG. 1A), right-side support structure 22 (FIG. 1A), and left-side support structure 24 (FIG. 1A).

Work surface 3 of desk 100 may be disposed at a current height. The current height may be adjustable. In some implementations, the adjustments in the current height of work surface 3 may have a vertical range of about 20 inches. In some implementations, the adjustments in the current height of work surface 3 may have a vertical range between about 15 inches and 25 inches. In some implementations, the adjustments in the current height of work surface 3 may have a vertical range between about 18 inches and 24 inches. In some implementations work surface 3 of working body 2 may have a surface area ranging from 46 inches to 52 inches in width. In some implementations work surface 3 of working body 2 may have a surface area of about 26 inches deep. In some implementations work surface 3 of working body 2 may have a surface area ranging between about 22 and about 30 inches deep.

By way of non-limiting example, FIG. 1C shows a view 100C of working body 2, with upright partition 19, work surface 3, and work surface support structure 4 which may include a control interface 5, a front facing center cavity 8*a*, a front facing adjacent cavity 8*b*, and/or other components. Upright partition 19 may include one or more protrusions (which may also be referred to as coupling portions), such as a first protrusion 19*a* and a second protrusion 19*b* (as depicted). The surfaces of the one or more protrusions may be in the same two-dimensional plane (or closely parallel thereto, within 1 inch) as the surface of upright partition 19. Work surface 3 may include a vertical slot 3*a* configured to hold securely first protrusion 19*a* and second protrusion 19*b* (such that first protrusion 19*a* and second protrusion can be inserted into vertical slot 3*a*). Work surface support structure 4 may include a vertical slot 4*a* configured to line up with vertical slot 3*a* such that first protrusion 19*a* and second protrusion 19*b* fit into both vertical slot 3*a* and vertical slot 4*a* at the same time. The bottom side of upright partition 19 (without the protrusions) extends beyond the width of vertical slot 3*a* (as shown, both on the left-hand side and the right-hand side) so that upright partition 19 rests on work surface 3 when first protrusion 19*a* and second protrusion 19*b* are inserted into vertical slot 3*a* (and into vertical slot 4*a*). In some implementations, upright partition 19 is configured to be (substantially) perpendicular to work surface 3.

In some implementations, control interface 5 may be configured to receive user input from the user. The location of control interface 5 on the desk is not limited by its exemplary illustration in FIG. 1C, which is merely meant to represent a convenient position for users to engage with control interface 5 to adjust the current height of work surface 3. By way of non-limiting example, control interface 5 may have one or more buttons to adjust the current height of work surface 3. For example, control interface 5 as shown in front view 200C (FIG. 2C) of working body 2 may have one or more of a lift button, a lower button, a lock/un-lock button, a memory button designating a user's preferred current height, and/or one or more other buttons used to control, adjust, and/or otherwise operate the current height of work surface 3.

In some implementations, the one or more cavities of work surface support structure 4 of working body 2 may be referred to as openings, orifices, chambers, cutouts, mortices, voids, vacant volumes, and/or other terminology to indicate useable spaces within work surface support structure 4. In some implementations, front facing center cavity 8*a* may contain a center tray 9. By way of non-limiting example, center tray 9 may be inserted and/or withdrawn from front facing center cavity 8*a*. In some implementations, front facing adjacent cavity 8*b* may contain a side tray 7. By way of non-limiting example, side tray 7 may be inserted and/or withdrawn from front facing adjacent cavity 8*b*. In some implementations, the cavities of work surface support structure 4 may contain other desk attachments and/or components other than trays. By way of non-limiting example, the cavities may include storage areas, keyboard and mouse housing, open-faced cavities, and/or other cavity functions.

FIG. 1F shows desk 100 with upright partition 19 that supports laterally-movable attachment 19*c*. As depicted, laterally-movable attachment 19*c* is a small shelf. Upright partition 19 may include lateral groove 21 (which may also be referred to as a track). Lateral groove 21 may extend laterally from the left side to the right side of upright partition 19 as depicted, e.g., near the top of upright partition 19. Laterally-movable attachment 19*c* may include one or more fasteners 21*a* (e.g., as depicted, two fasteners such as screws or bolts that fit into tapped holes that have been made into laterally-movable attachment 19*c*, as shown in more detail in FIG. 13B) configured to mechanically couple laterally-movable attachment 19*c*, via lateral groove 21, to upright partition 19. Fasteners 21*a* may be configured to removably attach to lateral groove 21, such that a user can move laterally-movable attachment 19*c* laterally along lateral groove 21, as preferred.

FIG. 1G shows desk 100 with upright partition 19 that supports laterally-movable attachment 19*d*. As depicted, laterally-movable attachment 19*d* is a wider shelf. In some implementations, as depicted, laterally-movable attachment 19*d* may be as wide as upright partition 19. Laterally-movable attachment 19*d* may include multiple fasteners (e.g., as depicted, a first set of fasteners 21*a* and a second set of fasteners 21*b*) configured to mechanically couple laterally-movable attachment 19*d*, via lateral groove 21, to upright partition 19. Fasteners 21*a* and 21*b* may be configured to removably attach to lateral groove 21, such that a user can couple or detach laterally-movable attachment 19*c* laterally along lateral groove 21, as preferred.

FIG. 1H shows desk 100 with upright partition 19 that supports laterally-movable attachment 19*e*. As depicted, laterally-movable attachment 19*e* is a diagonal support, such as may be used as a drafting table, a laptop stand, a tablet support, and/or other functionalities. In some implementations, as depicted, laterally-movable attachment 19*e* may rest on work surface 3. Laterally-movable attachment 19*e* may include fasteners 21 configured to mechanically couple laterally-movable attachment 19*e*, via lateral groove 21, to upright partition 19. Fasteners 21*a* may be configured to removably attach to lateral groove 21, such that a user can move, couple, or detach laterally-movable attachment 19*e* laterally along lateral groove 21, as preferred.

Figure 2A:
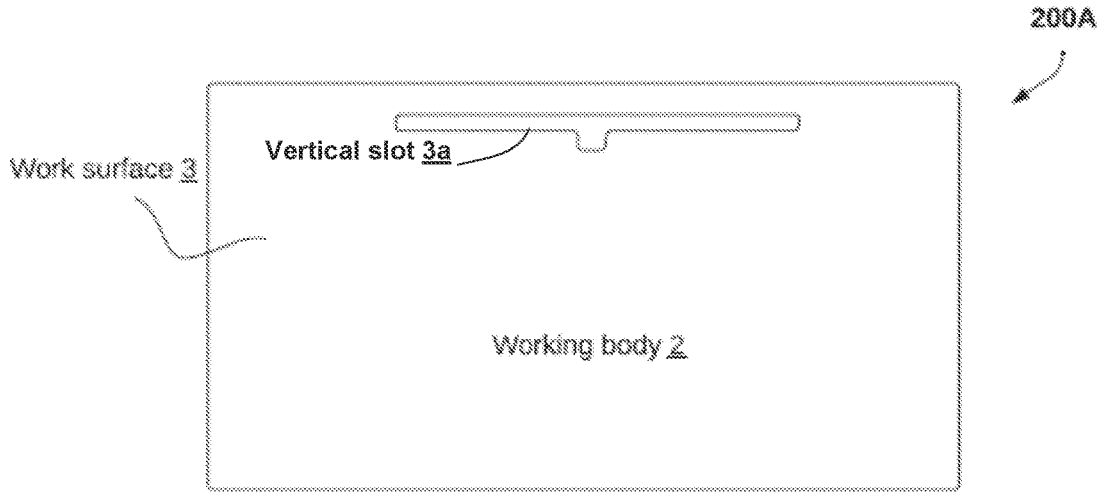
FIG. 2A shows a top view 200A of a working body, in accordance with one or more implementations.
Figure 2B:
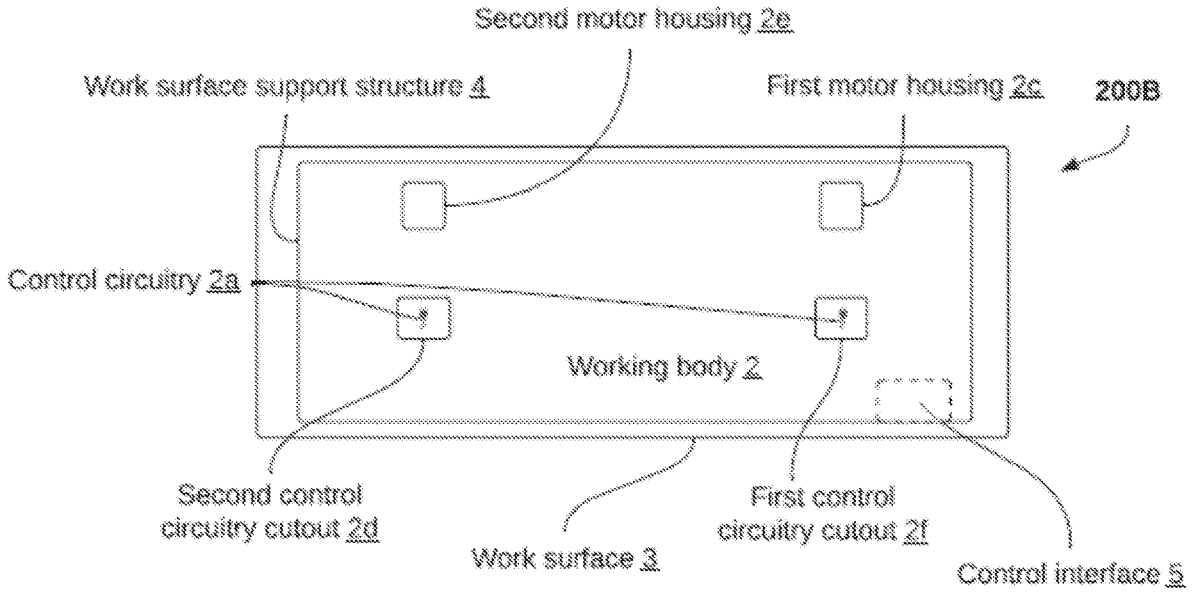
FIG. 2B shows a bottom view 200B of a working body, in accordance with one or more implementations.
Figure 2C:
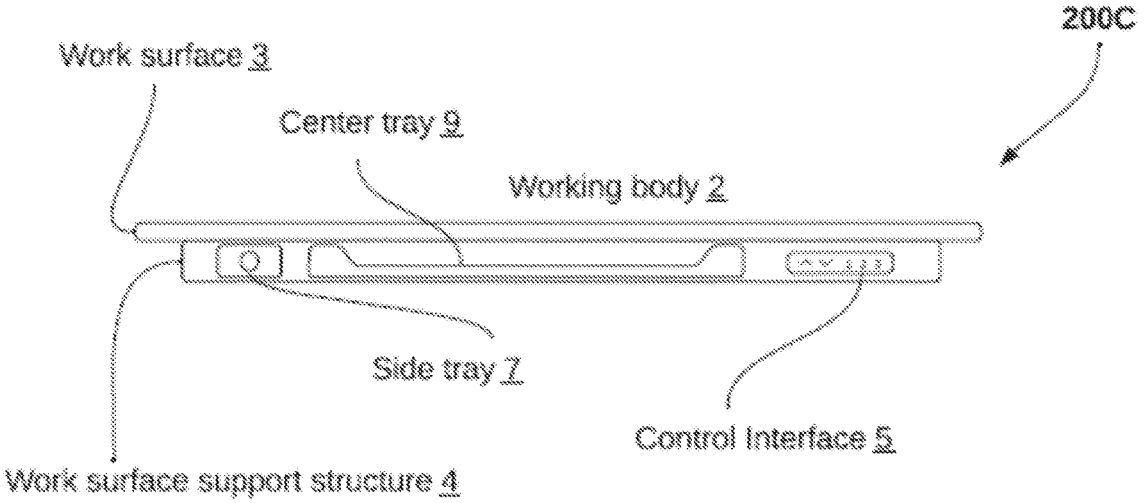
FIG. 2C shows a front view 200C of a working body, in accordance with one or more implementations.

FIG. 2A shows a top view 200A of a working body 2, including work surface 3 and vertical slot 3*a*. By way of non-limiting example, FIG. 2B shows a bottom view 200B of working body 2. In some implementations, working body 2 may include a first motor housing 2*c* positioned at the rear of work surface support structure 4. In some implementations, working body 2 may include a second motor housing 2*e*, positioned opposite of first motor housing 2*c* and at the rear of work surface support structure 4.

Referring to bottom view 200B of FIG. 2B, working body 2 may include a control circuitry 2*a*, a first control circuitry cutout 2*f*, a second control circuitry cutout 2*d*, and/or other components. In some implementations, control circuitry 2*a* may be configured to detect user input received by control interface 5. Responsive to the detection of the user input, first lifting mechanism 31 may be controlled to either lift working body 2 and increase the current height of work surface 3 or lower working body 2 and decrease the current height of work surface 3. Responsive to the detection of the user input, second lifting mechanisms 32 may be controlled to either lift working body 2 and increase the current height of work surface 3 or lower working body 2 and decrease the current height of work surface 3, e.g., in synchrony with lifting mechanism 31.

Figure 1D:
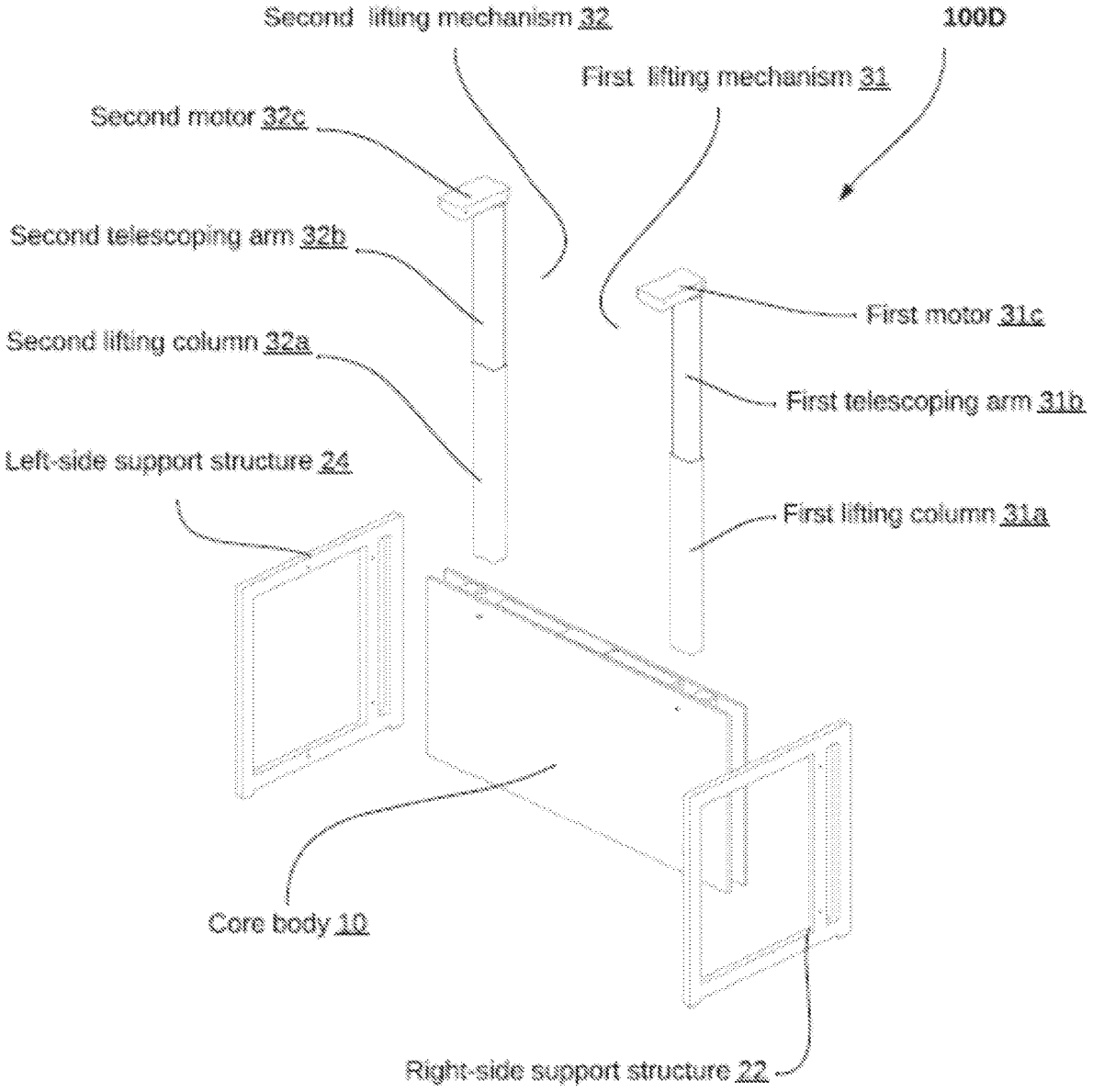
FIG. 1D shows a disassembled and/or exploded view of a core body, a first lifting mechanism, a second lifting mechanism, a left-side support structure, and a right-side support structure, in accordance with one or more implementations.

In some implementations, first control circuitry cutout 2*f* (e.g., orifice, chamber, opening, mortice, void, vacant volume) may be configured to allow users to easily access and connect control circuitry 2*a* to first lifting mechanism 31 (FIG. 1A) when first lifting mechanism 31 (FIG. 1A) is adjustably coupled to working body 2. In some implementations, second control circuitry cutout 2*d* (e.g., orifice, chamber, opening, mortice, void, vacant volume) may be configured to allow users to easily access and connect control circuitry 2*a* to second lifting mechanism 32 (FIG. 1A) when second lifting mechanism 32 (FIG. 1A) is adjustably coupled to working body 2. In some implementations, first motor housing 2*c* may be coupled to a first motor 31*c* (FIG. 1D) of first lifting mechanism 31 (FIG. 1D). Second motor housing 2*e* may be coupled to a second motor 32*c* (FIG. 1D) of second lifting mechanism 32 (FIG. 1D).

Figure 2D:
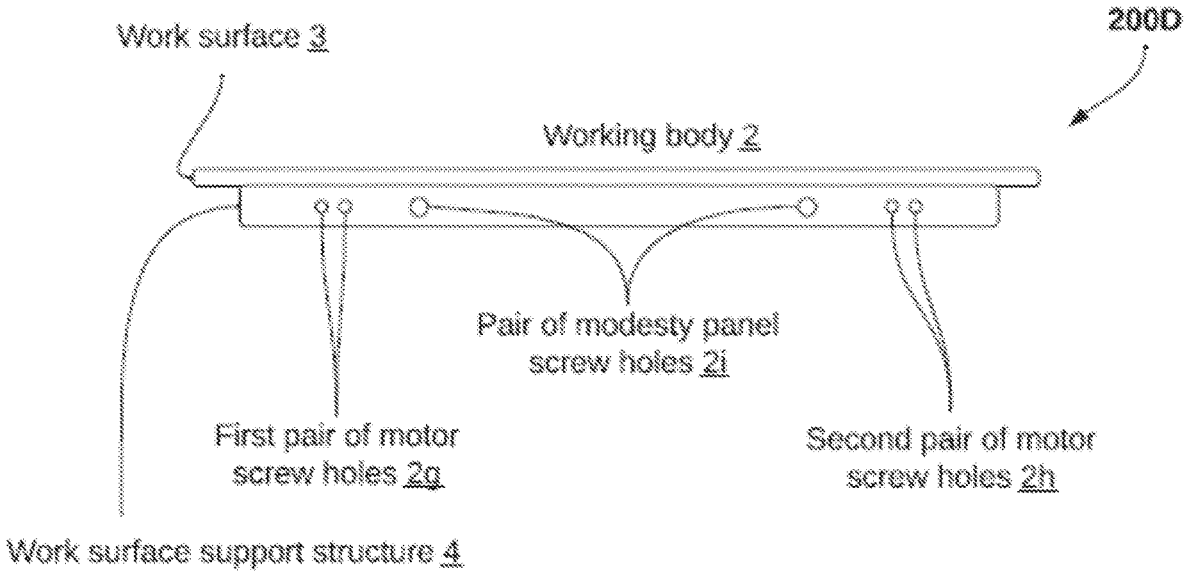
FIG. 2D shows a rear view 200D of a working body, in accordance with one or more implementations.

Referring to FIG. 2D, rear view 200D of working body 2 shows a first pair of motor screw holes 2*g*, a second pair of motor screw holes 2*h*, a pair of modesty panel screw holes 2*i*, and/or other components. First pair of motor screw holes 2*g* may be configured to include one or more screws, nuts, bolts, pins, and/or one or more other fastening hardware or fasteners to secure/fasten first motor 31*c* (FIG. 1D) of first lifting mechanism 31 (FIG. 1D) to first motor housing 2*c* (FIG. 2B) of working body 2. Second pair of motor screw holes 2*h* may be configured to include one or more of screws, nuts, bolts, pins, and/or one or more other fastening hardware or fasteners to secure/fasten second motor 32*c* (FIG. 1D) of second lifting mechanism 32 (FIG. 1D) to second motor housing 2*e* (FIG. 2B) of working body 2.

Core body 10 may be disposed vertically at a rear side of desk 100 with respect to work surface 3 of desk 100. Core body 10 may extend laterally between the left side and the right side of the desk. Core body 10 may be coupled to left-side support structure 24 (FIG. 1A), right-side support structure 22 (FIG. 1A), and/or other components. In some implementations, core body 10 may house first lifting mechanism 31 (FIG. 1A) and second lifting mechanism 32 (FIG. 1A). In some implementations, core body 10 (apart from first lifting mechanism 31 and second lifting mechanism 32) may be stationary relative to first lifting mechanism 31 and second lifting mechanism 32 during adjustments of the current height of the work surface 3.

Figure 1E:
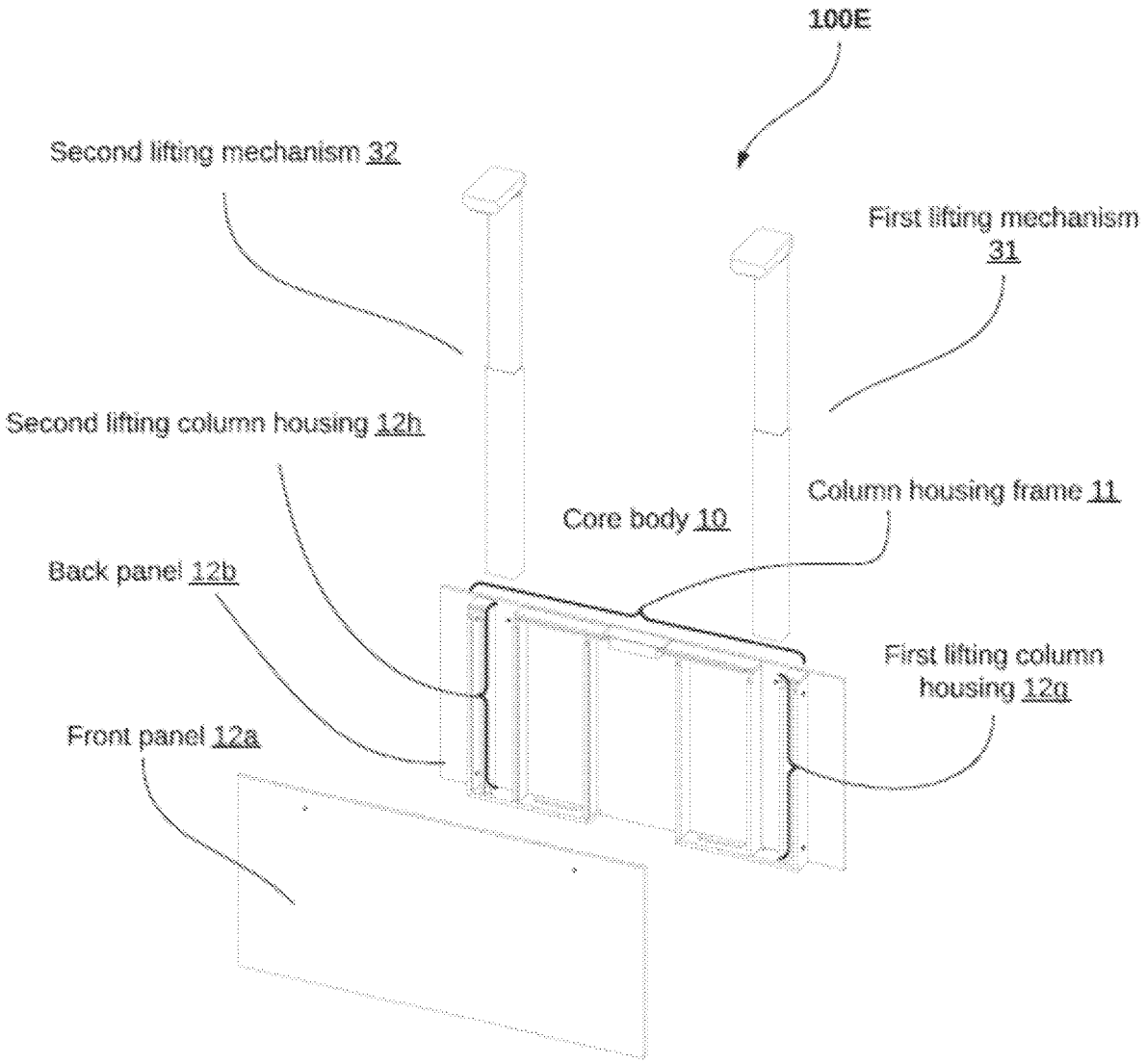
FIG. 1E shows a disassembled and/or exploded view of a core body, a first lifting mechanism, and a second lifting mechanism, in accordance with one or more implementations.
Figure 1F:
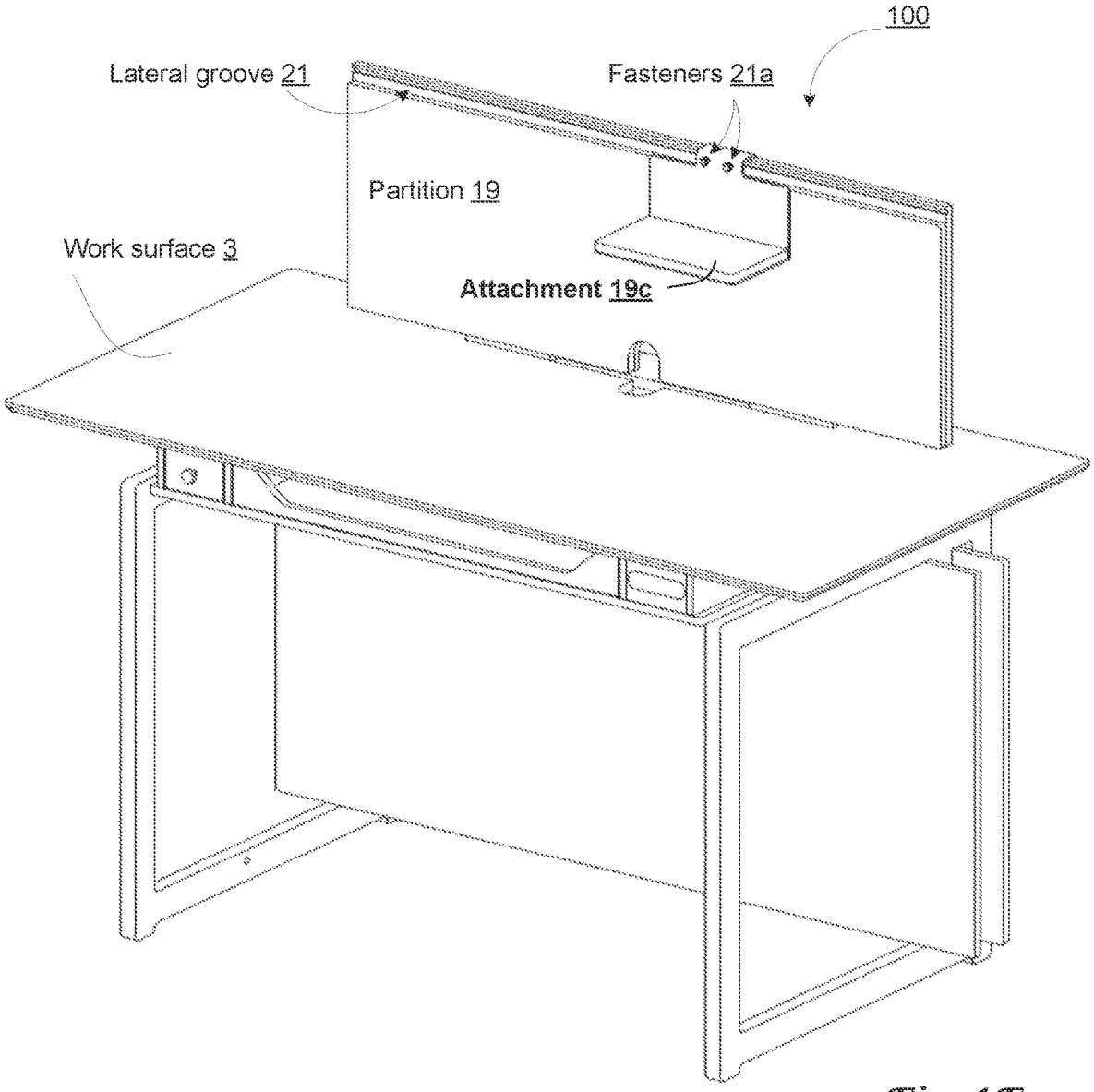
FIG. 1F shows a desk with an upright partition that supports a laterally-movable attachment, in accordance with one or more implementations.
Figure 1G:
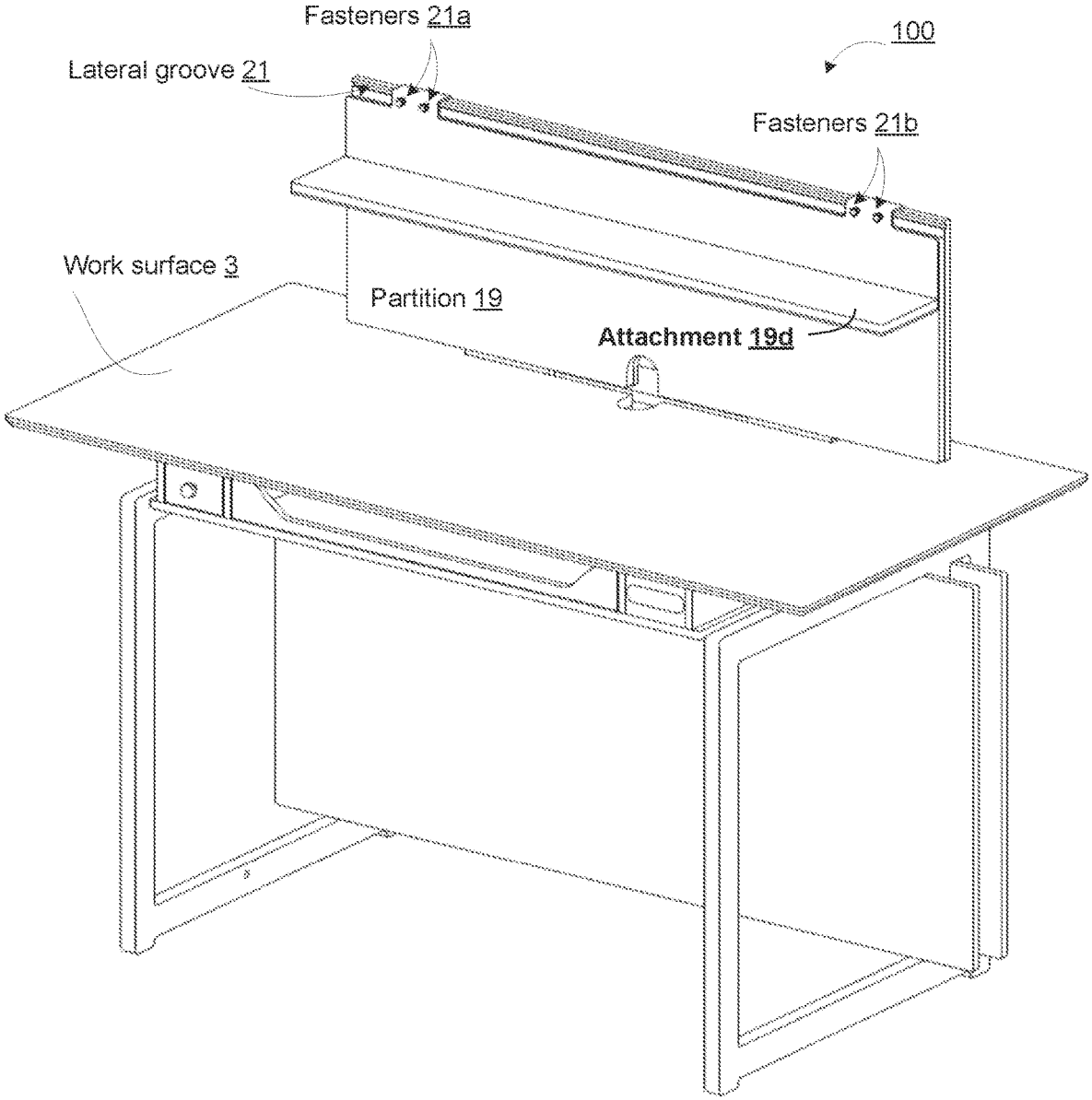
FIG. 1G shows a desk with an upright partition that supports a different laterally-movable attachment, in accordance with one or more implementations.
Figure 1H:
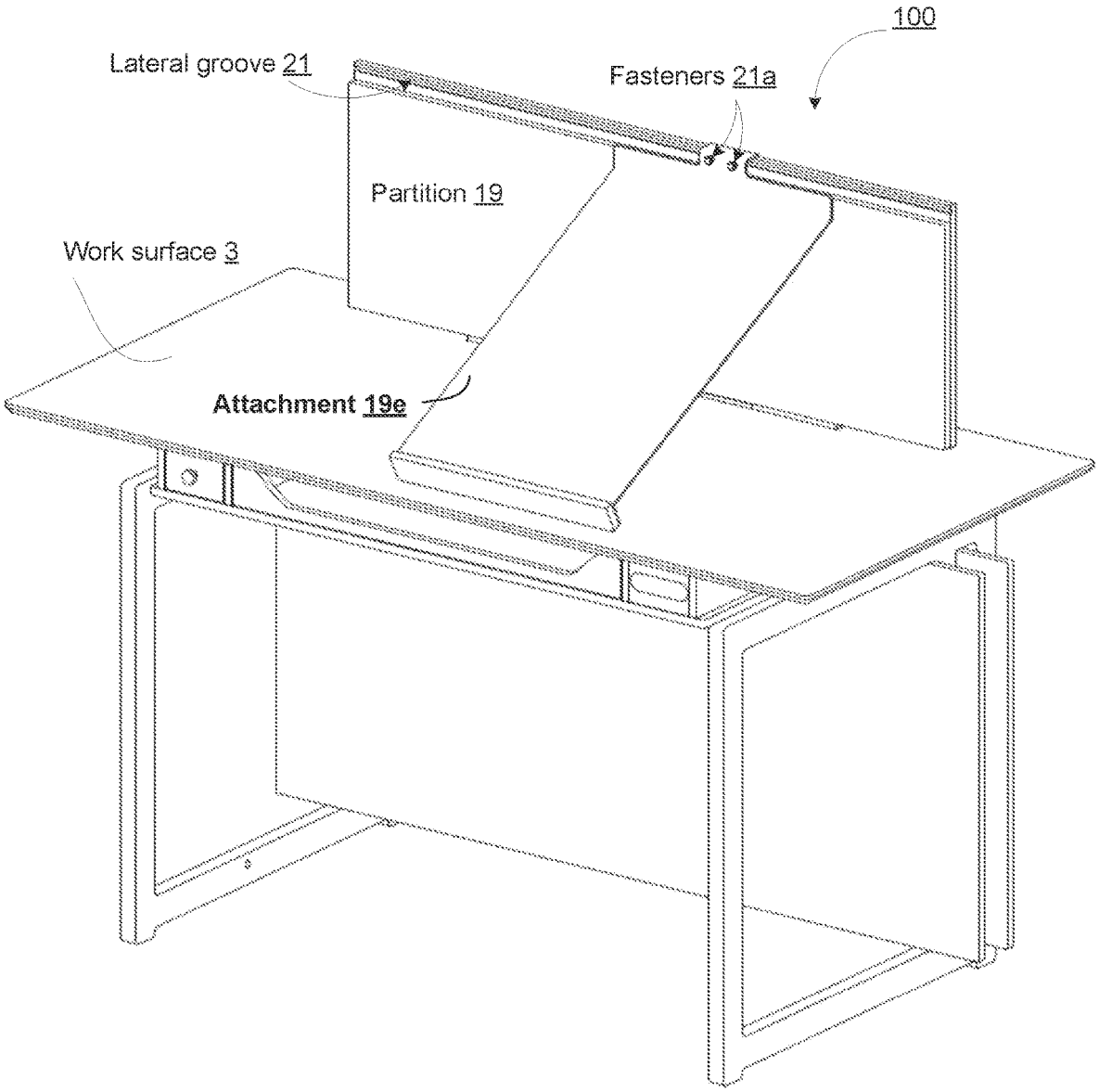
FIG. 1H shows a desk with an upright partition that supports another laterally-movable attachment, in accordance with one or more implementations.

Referring to exploded view 100E of FIG. 1E and by way of non-limiting example, core body 10 may be configured to include one or more of a column housing frame 11, a front panel 12*a*, a back panel 12*b*, a first lifting column housing 12*g*, a second lifting column housing 12*h*, and/or one or more other components. In some implementations, column housing frame 11 may have a front face, a rear face, a left face, and a right face. Column housing frame 11 may be configured to house first lifting column 31*a* and second lifting column 32*a*.

Figure 3A:
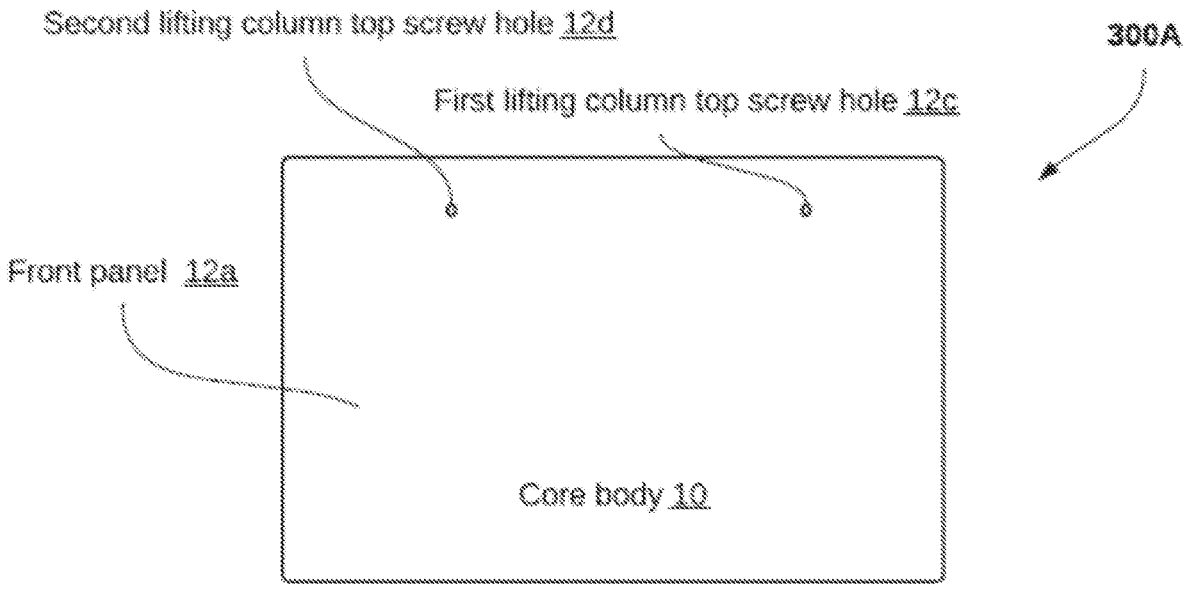
FIG. 3A shows a front view 300A of a core body, in accordance with one or more implementations.
Figure 3B:
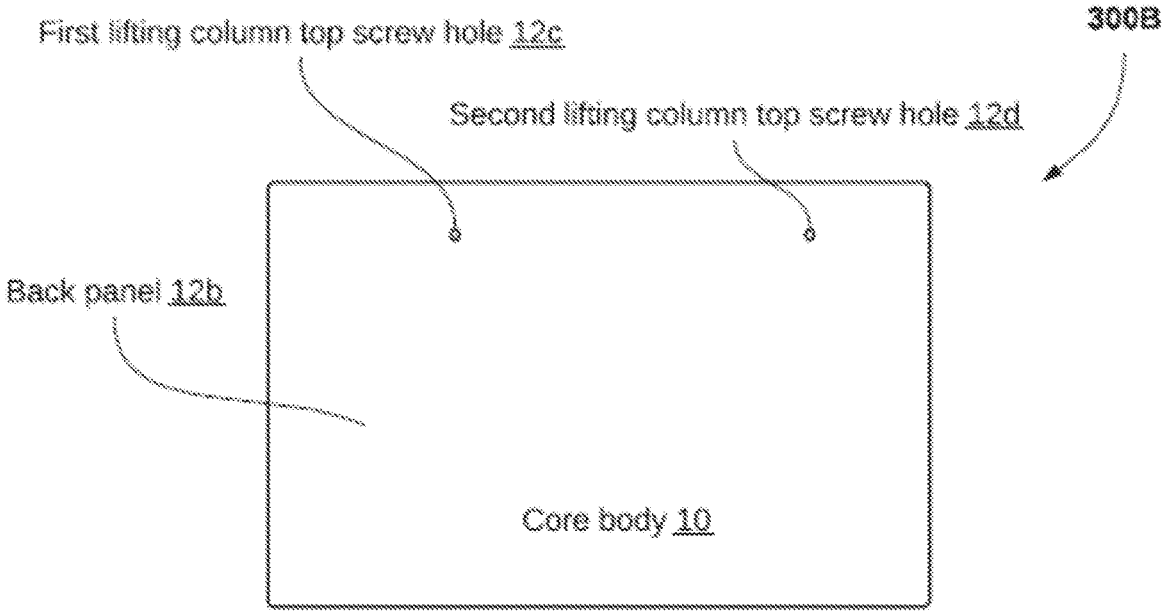
FIG. 3B shows a rear view 300B of a core body, in accordance with one or more implementations.

FIG. 3A shows a core body front view 300A. FIG. 3B shows a core body rear view 300B. In some implementations, front panel 12*a* (see FIG. 3A) and back panel 12*b* (see FIG. 3B) of core body 10 may include a first lifting column top screw hole 12*c* and a second lifting column top screw hole 12*d*. First lifting column top screw hole 12*c* may be configured to secure first lifting column 31*a* (FIG. 1D) to core body 10. Second lifting column top screw hole 12*d* may be configured to secure second lifting column 32*a* (FIG. 1D) to core body 10.

Figure 3C:
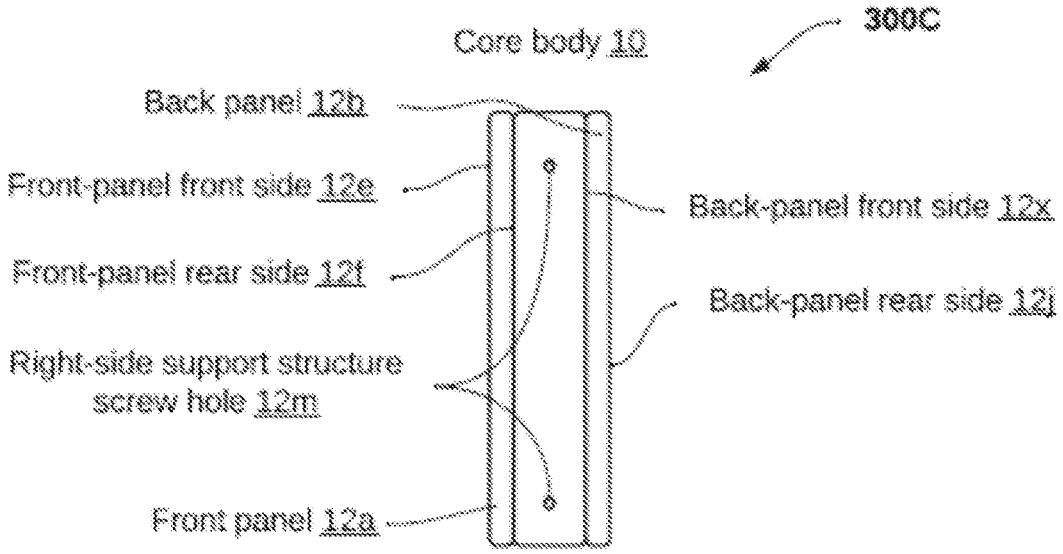
FIG. 3C shows a right-side view 300C of a core body, in accordance with one or more implementations.
Figure 3D:
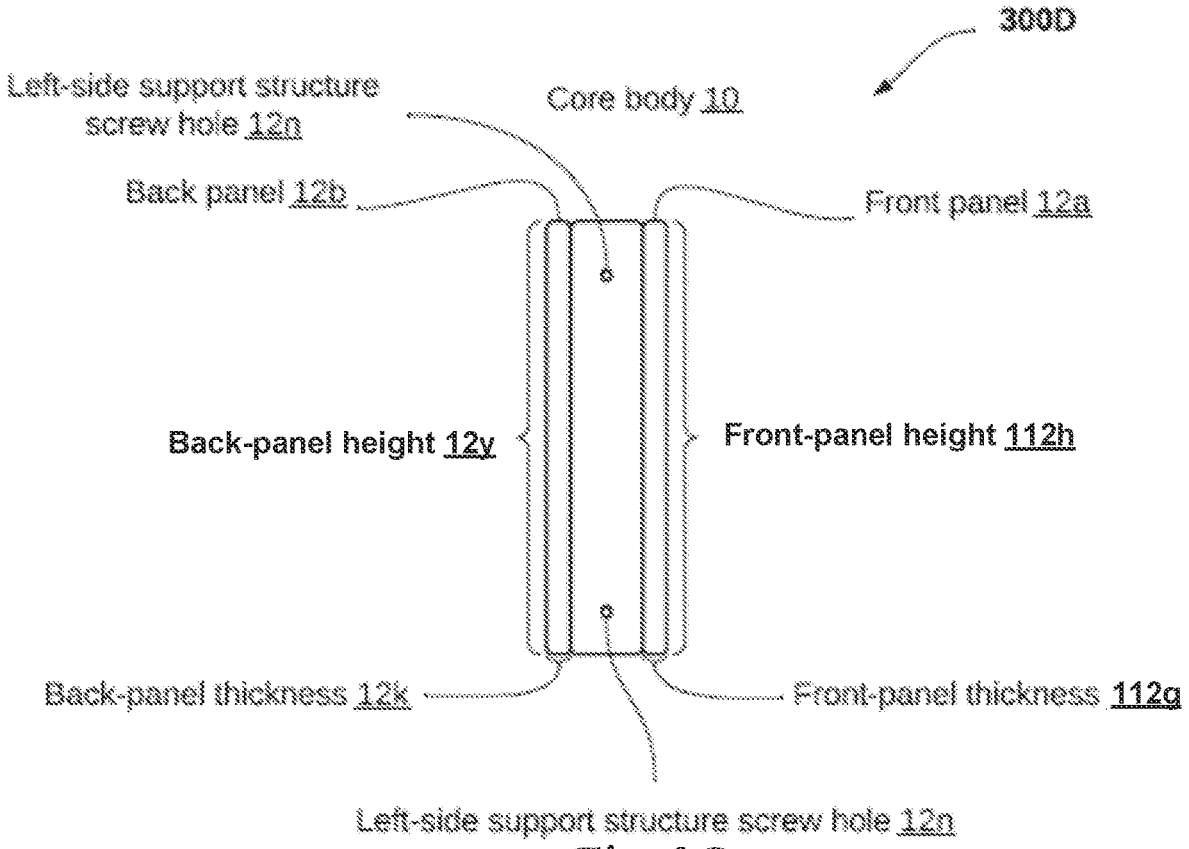
FIG. 3D shows a left-side view 300D of a core body, in accordance with one or more implementations.
Figure 4A:
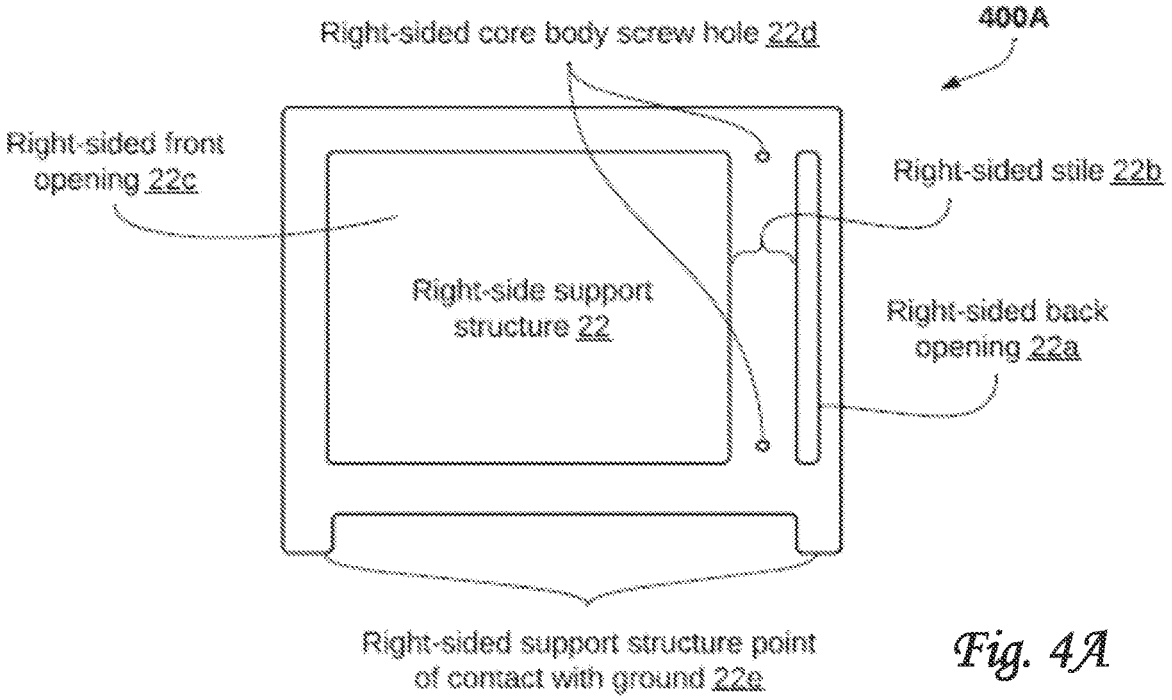
FIG. 4A shows an outside view 400A of a right-side support structure, in accordance with one or more implementations.

FIG. 3C shows a right-side view 300C of core body 10. FIG. 3D shows a left-side view 300D of core body 10. In some implementations, back panel 12*b* may include a back-panel front side 12*x* (FIG. 3C), and a back-panel rear side 12*j* (FIG. 3C). Back-panel front side 12*x* (FIG. 3C) of back panel 12*b* may be coupled to the rear of column housing frame 11 (FIG. 1E). Back panel 12*b* may be configured to provide support for core body 10 by being inserted into a left-sided back opening 24*a* (FIG. 4C) of left-side support structure 24 (FIG. 4C) and a right-sided back opening 22*a* (FIG. 4A) of right-side support structure 22 (FIG. 4A). In some implementations, back panel 12*b* may include a back-panel height 12*y* (FIG. 3D), and a back-panel thickness 12*k* (FIG. 3D).

In some implementations, front panel 12*a* may include a front-panel front side 12*e* (FIG. 3C) and a front-panel rear side 12*f* (FIG. 3C). Front-panel rear side 12*f* (FIG. 3C) of front panel 12*a* may be coupled to the front of housing frame 11 (FIG. 1E). Front panel 12*a* may be configured to provide support for core body 10 by being inserted into a left-sided front opening 24*c* (FIG. 4C) of left-side support structure 24 (FIG. 4C) and a right-sided front opening 22*c* (FIG. 4A) of right-side support structure 22 (FIG. 4A). In some implementations, front panel 12*a* may include a front-panel height 112*h* (FIG. 3D) and a front-panel thickness 112*g* (FIG. 3D).

Figure 3E:
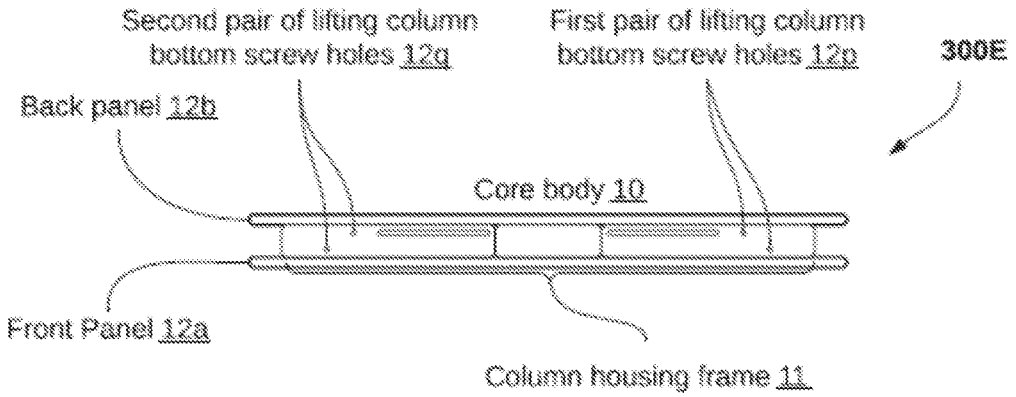
FIG. 3E shows a bottom view 300E of a core body, in accordance with one or more implementations.
Figure 3F:
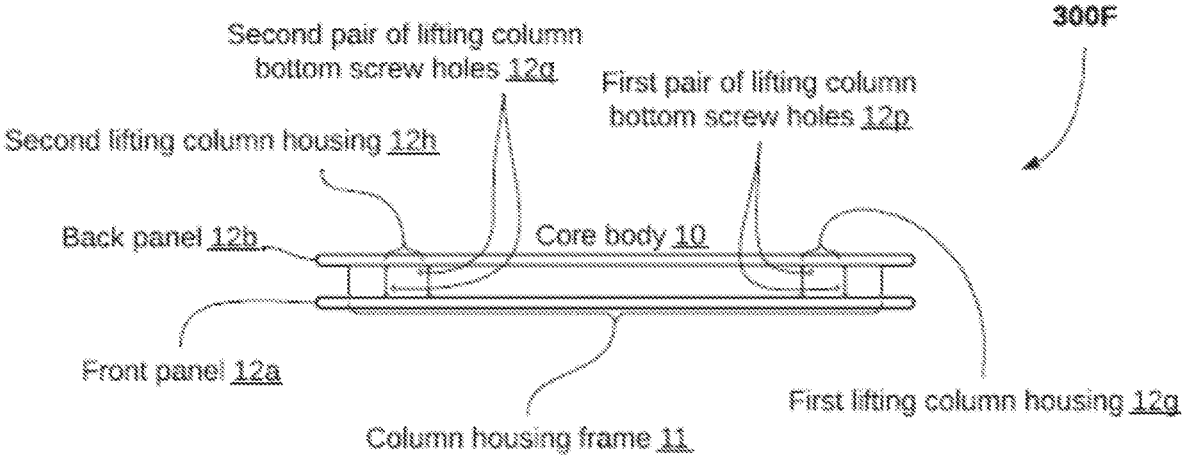
FIG. 3F shows a top view 300F of a core body, in accordance with one or more implementations.

FIG. 3E shows a bottom view 300E of core body 10, including a first pair of lifting column bottom screw holes 12*p*, a second pair of lifting column bottom screw holes 12*q*, and/or other components. First pair of lifting column bottom screw holes 12*p* may be configured to include one or more screws, nuts, bolts, pins, and/or one or more other fastening hardware or fasteners to secure/fasten first lifting column 31*a* (FIG. 1D) of first lifting mechanism 31 (FIG. 1D) to first lifting column housing 12*g* (FIG. 1E) of core body 10. Second pair of lifting column screw holes 12*q* may be configured to include one or more of screws, nuts, bolts, pins, and/or one or more other fastening hardware or fasteners to secure/fasten second lifting column 32*a* (FIG. 1D) of second lifting mechanism 32 (FIG. 1D) to second lifting column housing 12*h* (FIG. 1E) of core body 10.

In some implementations, first lifting mechanism 31 may be coupled to core body 10 by first lifting column 31*a* (FIG. 1D) being inserted into first lifting column housing 12*g* (FIG. 1E). In some implementations, second lifting mechanism 32 may be coupled to core body 10 by second lifting column 32*a* (FIG. 1D) being inserted into second lifting column housing 12*h* (FIG. 1E).

Figure 4B:
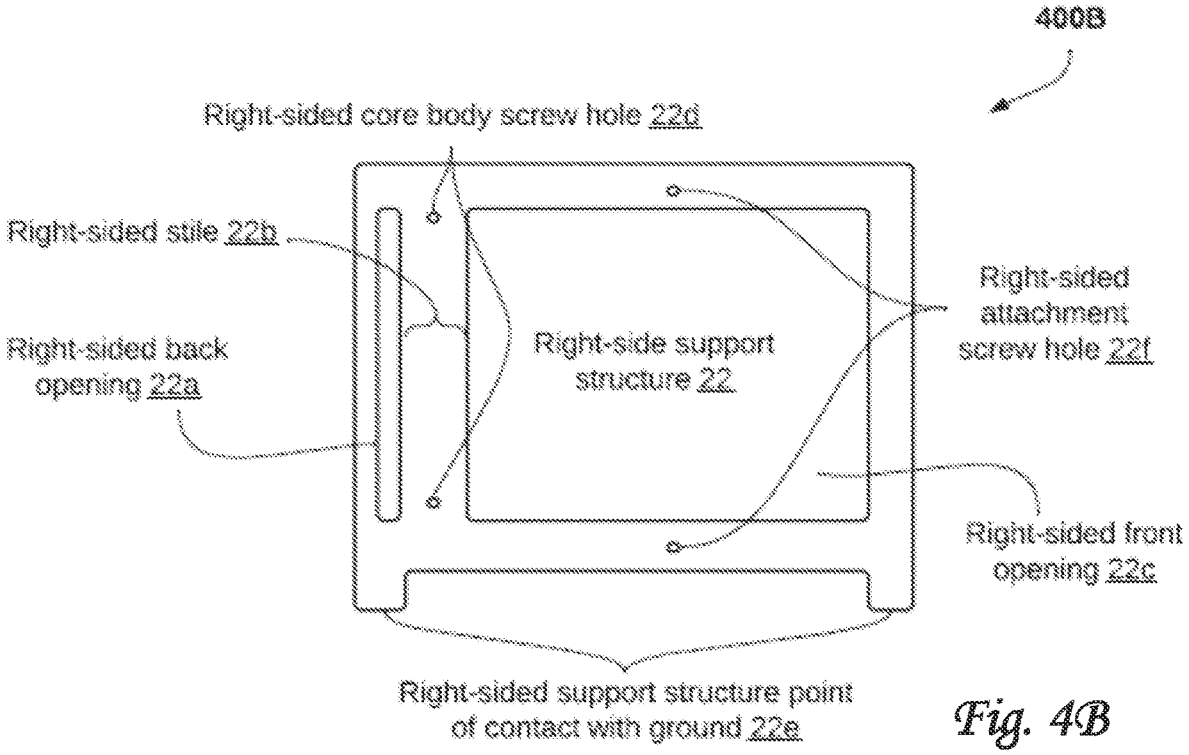
FIG. 4B shows an inside view 400B of a right-side support structure, in accordance with one or more implementations.
Figure 4C:
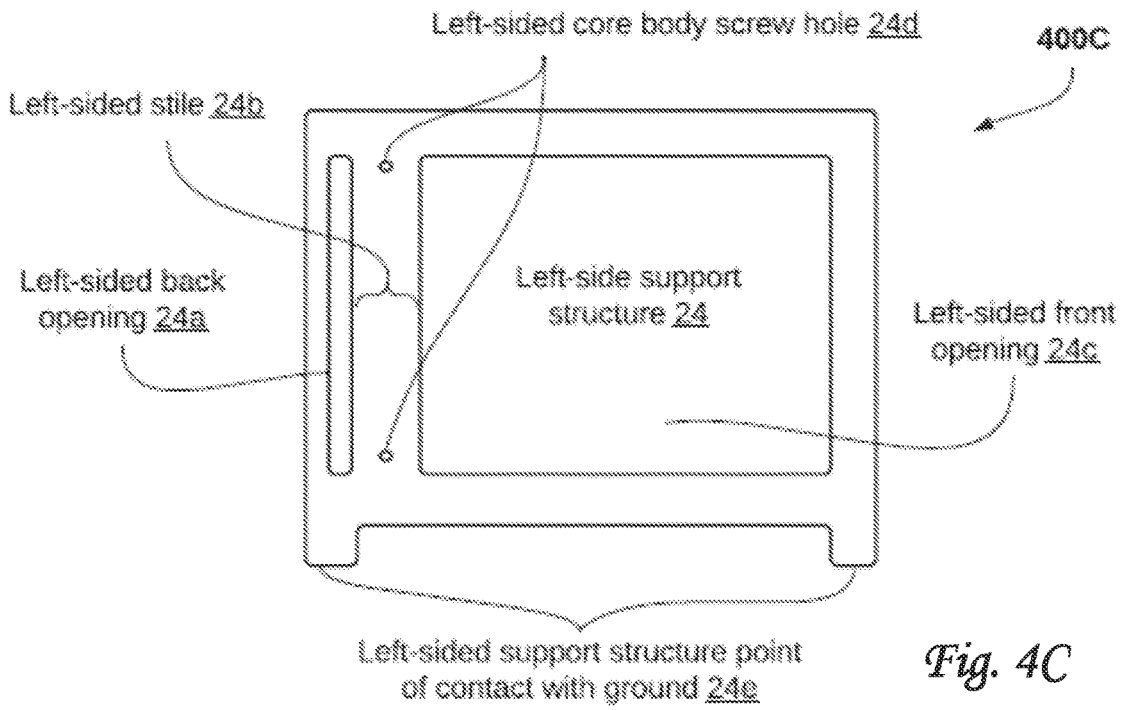
FIG. 4C shows an outside view 400C of a left-side support structure, in accordance with one or more implementations.
Figure 6:
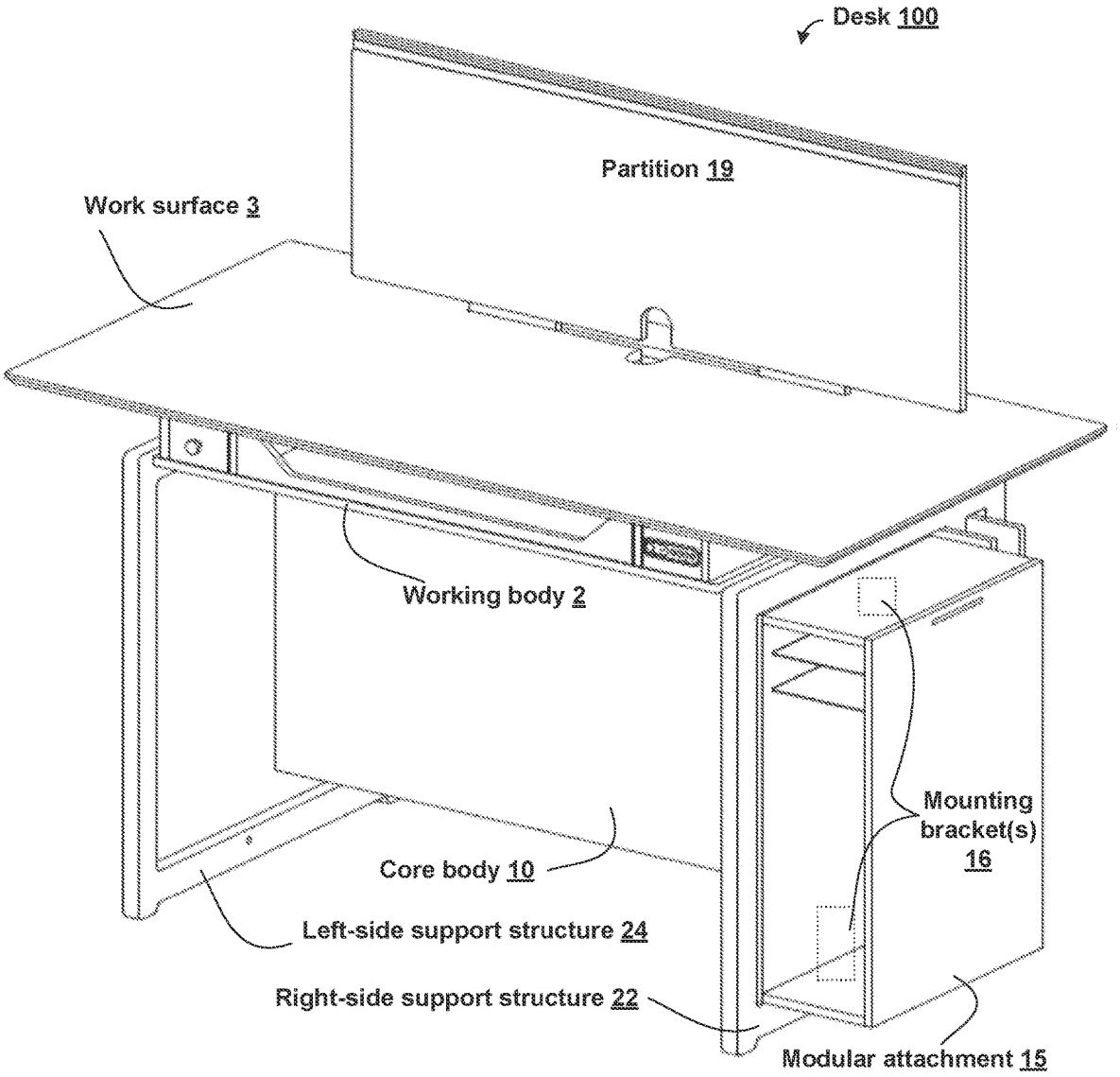
FIG. 6 shows an assembled view of a desk, in accordance with one or more implementations.

By way of non-limiting example, both views 300E and 300F show a length of front panel 12*a* and a length of back panel 12*b*, each of which may be greater than a length of column housing frame 11. In some implementations, the extra length of the front panel 12*a* may be configured to be inserted into right-sided front opening 22*c* (FIG. 4A) and left-sided front opening 24*c* (FIG. 4C). In some implementations, as shown in FIG. 1B, inserting front panel 12*a* into right-sided front opening 22*c* and left-sided front opening 24*c* leaves almost the entirety of right-sided front opening 22*c* and left-sided front opening 24*c* available (minus front-panel thickness 112*g*), e.g., for one or more modular attachments (such as, by way of non-limiting example, modular attachment 15 as depicted in FIG. 6). In some implementations, the extra length of the back panel 12*b* may be configured to be inserted into right-sided back opening 22*a* (FIG. 4A) and left-sided back opening 24*a* (FIG. 4C).

Referring to exploded view 100D of FIG. 1D, first lifting mechanism 31 may include one or more of first motor 31*c*, a first telescoping arm 31*b*, first lifting column 31*a*, and/or other components. In some implementations, first lifting mechanism 31 may have at least two stages. Second lifting mechanism 32 may include one or more of second motor 32*c*, a second telescoping arm 32*b*, second lifting column 32*a*, and/or other components. In some implementations, second lifting mechanism 32 may have at least two stages. In some implementations, first and second telescoping arms (31*b*, 32*b*) are the only visibly moving parts of the entire desk when the desk is being lifted and/or lowered (during use, after assembly). In some implementations, first lifting mechanism 31 may include a first mechanical linear actuator. Second lifting mechanism 32 may include a second mechanical linear actuator. Controlling first and second lifting mechanisms (31, 32) may include controlling the first mechanical linear actuator and the second mechanical linear actuator in synchrony.

Figure 4D:
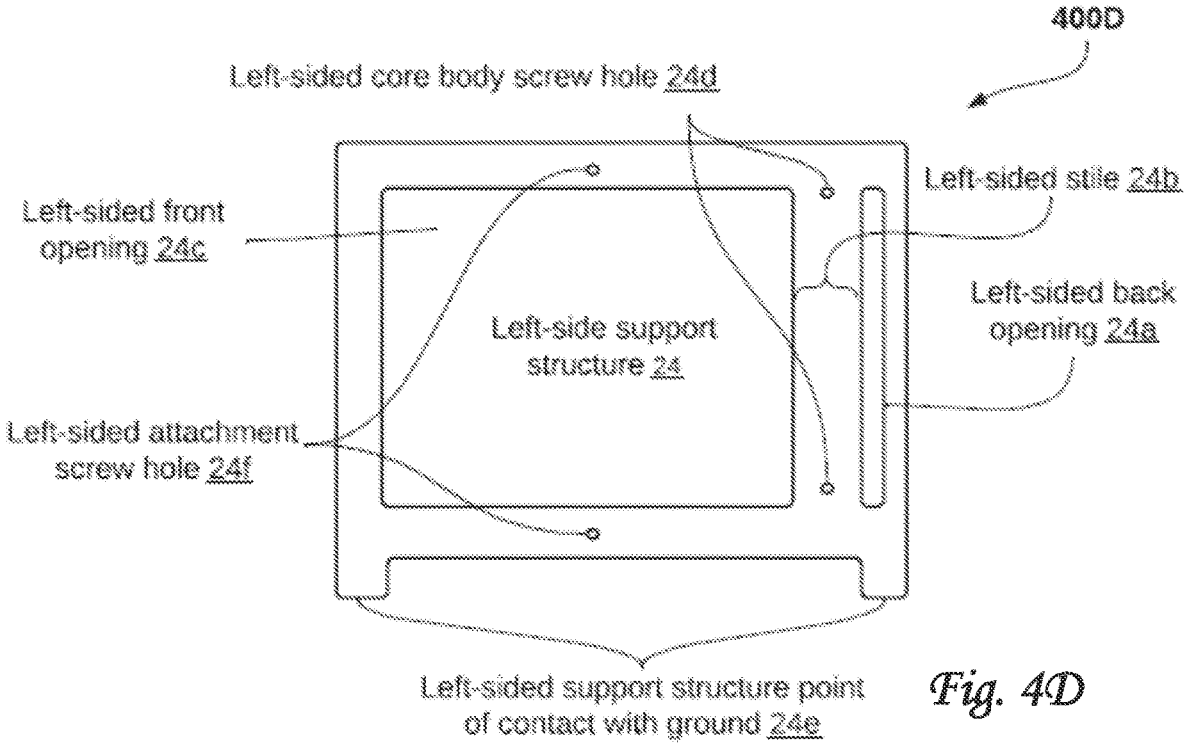
FIG. 4D shows an inside view 400D of a left-side support structure, in accordance with one or more implementations.

Referring to FIG. 1A, left-side support structure 24 may be disposed at a left side of desk 100 with respect to work surface 3 of working body 2. In some implementations, left-side support structure 24 may be stationary during adjustments of the current height of work surface 3. FIG. 4D shows an inside view 400D of left-side support structure 24. FIG. 4C shows an outside view 400C of left-side support structure 24. In some implementations, left-side support structure 24 may include left-sided back opening 24*a* and left-sided front opening 24*c* in front of left-sided back opening 24*a*.

Left-sided back opening 24*a* of left-side support structure 24 may be configured to include a first width at least as wide as back-panel thickness 12*k* (FIG. 3D) and a first height at least as long as back-panel height 12*y* (FIG. 3D). In some implementations, left-side support structure 24 may be configured to include a left-sided stile 24*b*, disposed between left-sided back opening 24*a* and left-sided front opening 24*c*. Left-sided stile 24*b* may be configured to have a width less than a distance between back-panel front side 12*x* (FIG. 3C) and front-panel rear side 12*f* (FIG. 3C). By way of non-limiting example, left-sided stile 24*b* of left side support structure 24 may be identified as one or more of a left-sided post, a left-sided connector, a left-sided closing, a left-sided panel, a left-sided member, and/or other terms that properly identify 24*b*.

In some implementations, left-side support structure 24 may be configured to include left-sided front opening 24*c* comprised of a width and a height. In some implementations, the width of left-sided front opening 24*c* may be in the range of 80%-95% of a width of left-side support structure 24. In some implementations, the width of left-sided front opening 24*c* may be in the range of 70%-85% of a width of left-side support structure 24. In some implementations, the width of left-sided front opening 24*c* may be in the range of 60%-80% of a width of left-side support structure 24, as depicted in FIG. 4A. In some implementations, the height of left-sided front opening 24*c* may be in the range of 80%-95% of a height of left-side support structure 24. In some implementations, the height of left-sided front opening 24*c* may be in the range of 70%-85% of a height of left-side support structure 24. In some implementations, the height of left-sided front opening 24*c* may be in the range of 60%-80% of a height of left-side support structure 24, as depicted in FIG. 4A. In some implementations, the width of left-sided front opening 24*c* may range between 14 and 17 inches, or between 15 and 20 inches. For example, the width of left-sided front opening 24*c* may be about 15 inches. In some implementations, the height of left-sided front opening 24*c* may range between 18 and 23 inches, or between 20 and 25 inches. For example, the height of left-sided front opening 24*c* may be about 21 inches.

In some implementations, a shape of left-side support structure 24 as viewed from the left side of desk 100 may be a rectangular shape. By way of non-limiting illustration, the shape of left-side support structure 24 as viewed from the left side of desk 100 may be one or more of a circle, triangle, and/or other geometric shapes. It is noted that a difference in the shape of the left-side support structure as viewed from the left side may change many other components of desk 100. In implementations where a side support structure would have a different shape than depicted, the same manner of coupling components together would be retained so that working body 2 would be lifted and/or lowered by lifting mechanisms positioned at its rear and having support structures on the side of desk 100.

Referring to FIG. 6, right-sided front opening 22*c* may be configured to support one or more modular attachments, including but not limited to modular attachment 15, which may be, e.g., a storage unit or a waste bin holder (with two shelves near the top). For example, as shown, a side of modular attachment 15 may be supported by (the inside of) a bottom portion of right-side support structure 22 at or near the bottom of right-sided front opening 22*c*. For example, as shown, part of modular attachment 15 may be inserted into right-sided front opening 22*c* and may rest on (the inside of) the bottom portion of right-side support structure 22 at or near the bottom of left-sided front opening 22*c*. In some implementations, right-side support structure 22 may have a thickness between about 0.5 inch and 1 inch, or between 1 and 2 inches, to provide this support. In some implementations, one or more mounting brackets 16 may be configured to mechanically couple modular attachment 15 to either left-side support structure 24 (not depicted) or right-side support structure 22 (as shown in FIG. 6, e.g., by using one or both of attachment screw holes 22*f* shown in FIG. 4B). For example, the top attachment screw hole 22*f* may be used to mechanically couple the top left side of modular attachment 15 to right-side support structure 22 (by using a mounting bracket 16 in the orientation depicted in FIG. 10A), and the bottom attachment screw hole 22*f* may be used to mechanically couple the bottom left side of modular attachment 15 to right-side support structure 22 (by using a mounting bracket 16 in the orientation depicted in FIG. 10B). Note that the attachment screw hole (and/or the attachment to the support structure) is on the opposite side as the placement of modular attachment 15. For example, and as depicted in FIG. 6, modular attachment 15 is placed on the outside of right-side support structure 22 and the one or more mounting brackets 16 are attached to the inside of right-side support structure 22.

FIG. 6 depicts modular attachment 15 as being coupled on the outside of right-side support structure 22. However, this is exemplary and not intended to be limiting. In some implementations, modular attachment 15 may be coupled on the inside of right-side support structure 22. In other implementations, modular attachment 15 may be coupled on the outside of left-side support structure 24 (e.g., by using one or both of left-side attachment screw holes 24*f*). In other implementations, modular attachment 15 may be coupled on the inside of left-side support structure 24. FIG. 6 further depicts upright partition 19 coupled to work surface 3.

Figure 7:
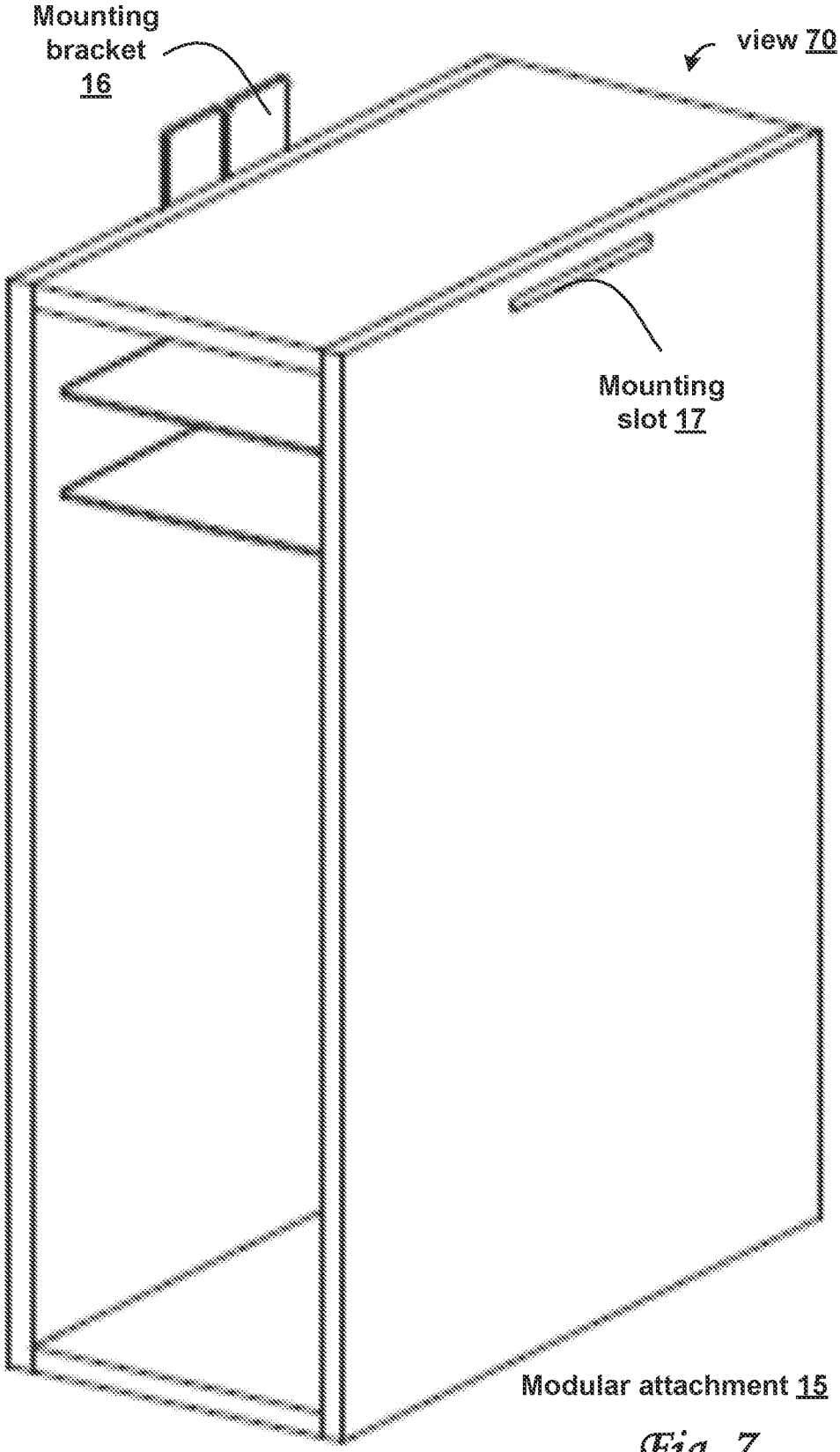
FIG. 7 shows a view of a modular attachment configured to be attached to a desk, in accordance with one or more implementations.
Figure 10A:
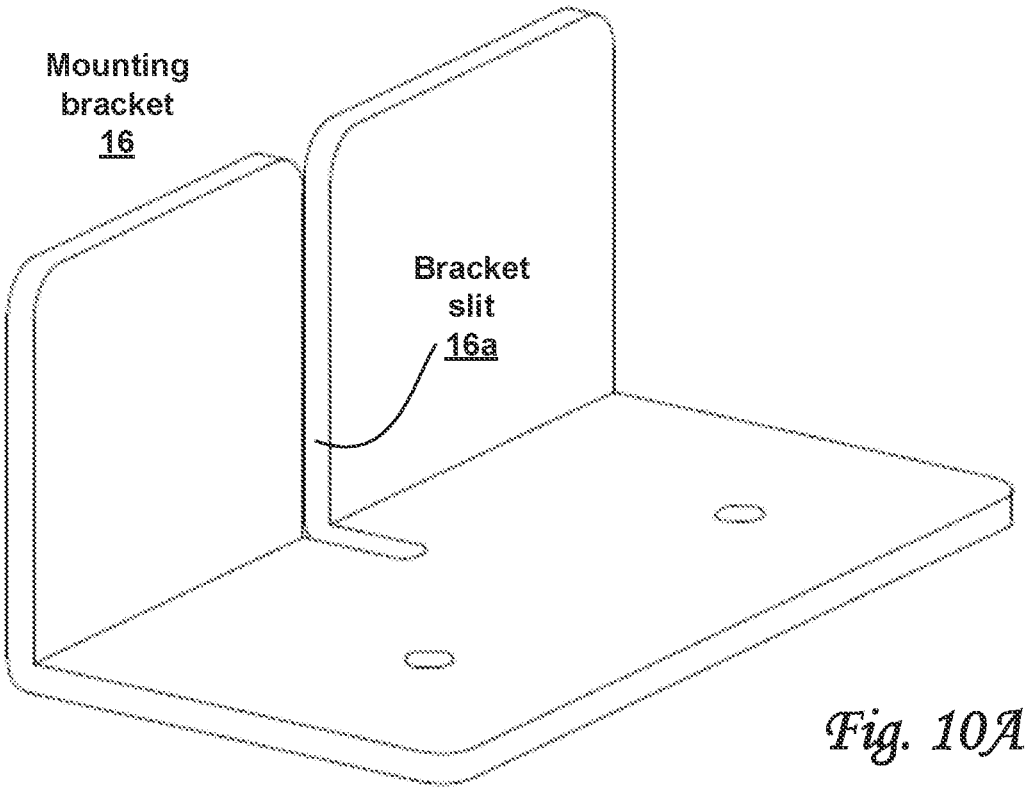
FIG. 10A-10B show mounting brackets for use with a desk, in accordance with one or more implementations.
Figure 10B:
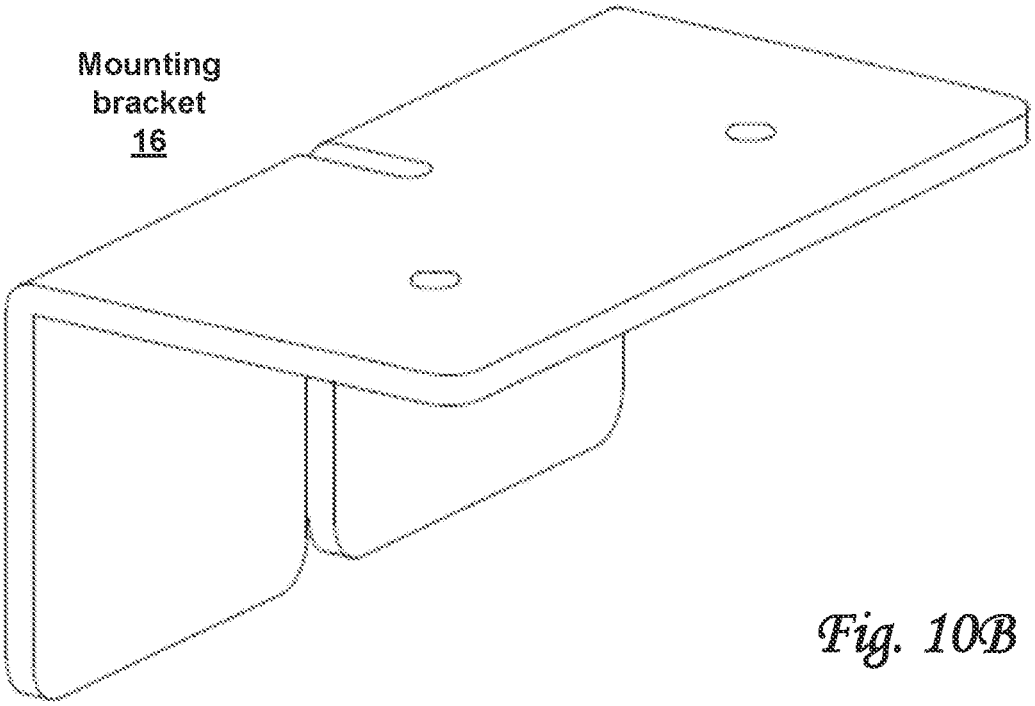

FIG. 7 shows a view 70 of modular attachment 15, including a mounting slot 17, one or more mounting brackets 16, and/or other components. By way of non-limiting example, mounting slot 17 may be configured such that a mounting bracket 16 can be inserted into mountain slot 17 and mechanically coupled to modular attachment 15. Modular attachment 15 may include a second mounting slot (not visible in view 70) on the left side of modular attachment 15 that is used to mechanically couple mounting bracket 16 to modular attachment 15. Additionally, mounting bracket 16 may be configured to mechanically couple to one of the support structures. For example, FIG. 10A shows mounting bracket 16, including a bracket slit 16*a*. In some implementations, mounting bracket 16 may be mechanically coupled to one of the support structures by connecting a fastener through bracket slit 16*a*, such as, e.g., a screw or bolt. As depicted in FIG. 10A, mounting bracket 16 may be an L-shaped bracket, and/or a right-angle bracket. In some implementations, bracket slit 16*a* may be in the center of at least one of the two angled portions of mounting bracket 16. As depicted, bracket slit 16*a* may be opened on one side (the top side in the orientation of FIG. 10A). FIG. 10B shows the same mounting bracket 16 as FIG. 10A, but in a reversed orientation.

Figure 8:
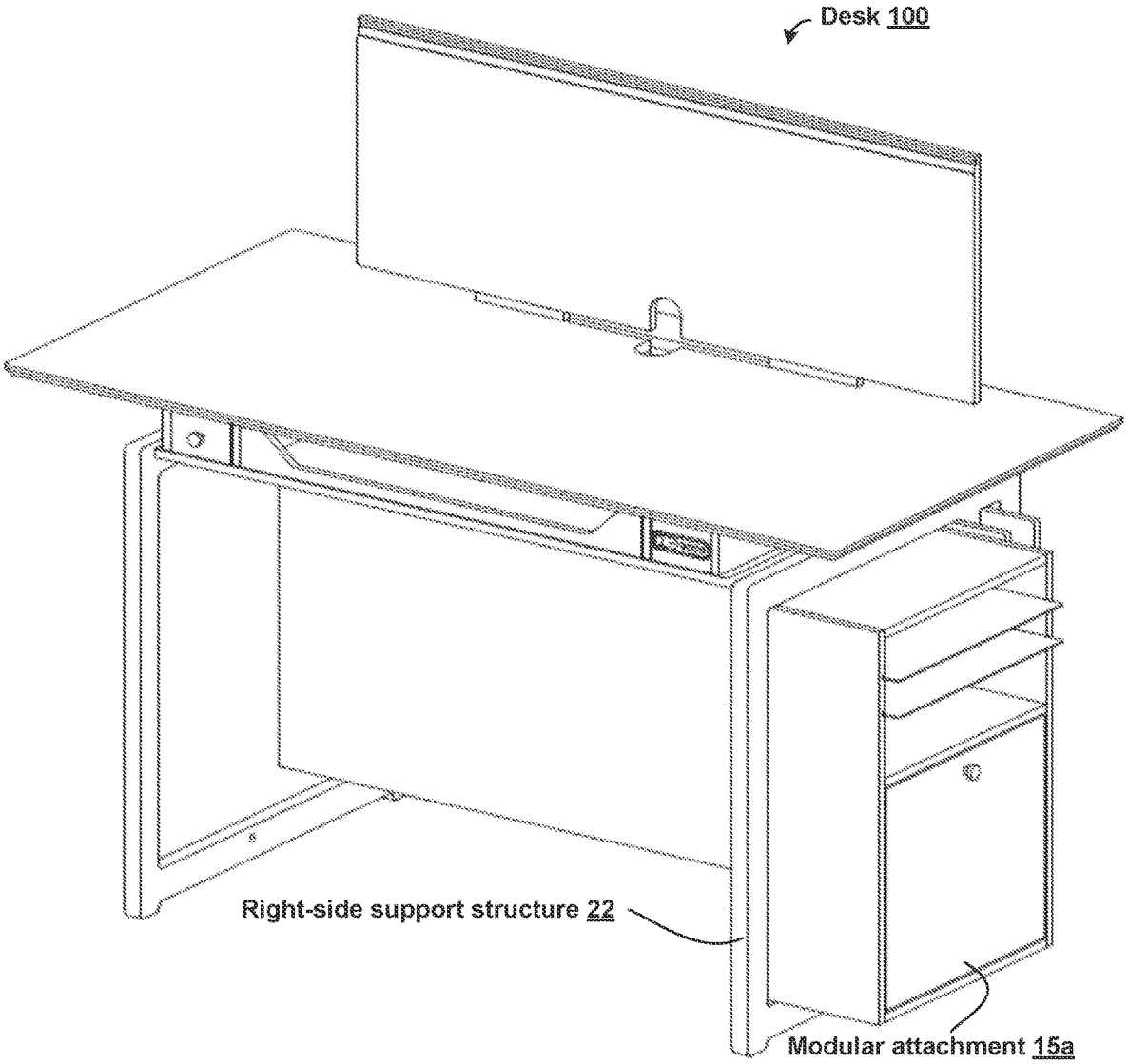
FIG. 8 shows an assembled view of a desk, in accordance with one or more implementations.
Figure 9:
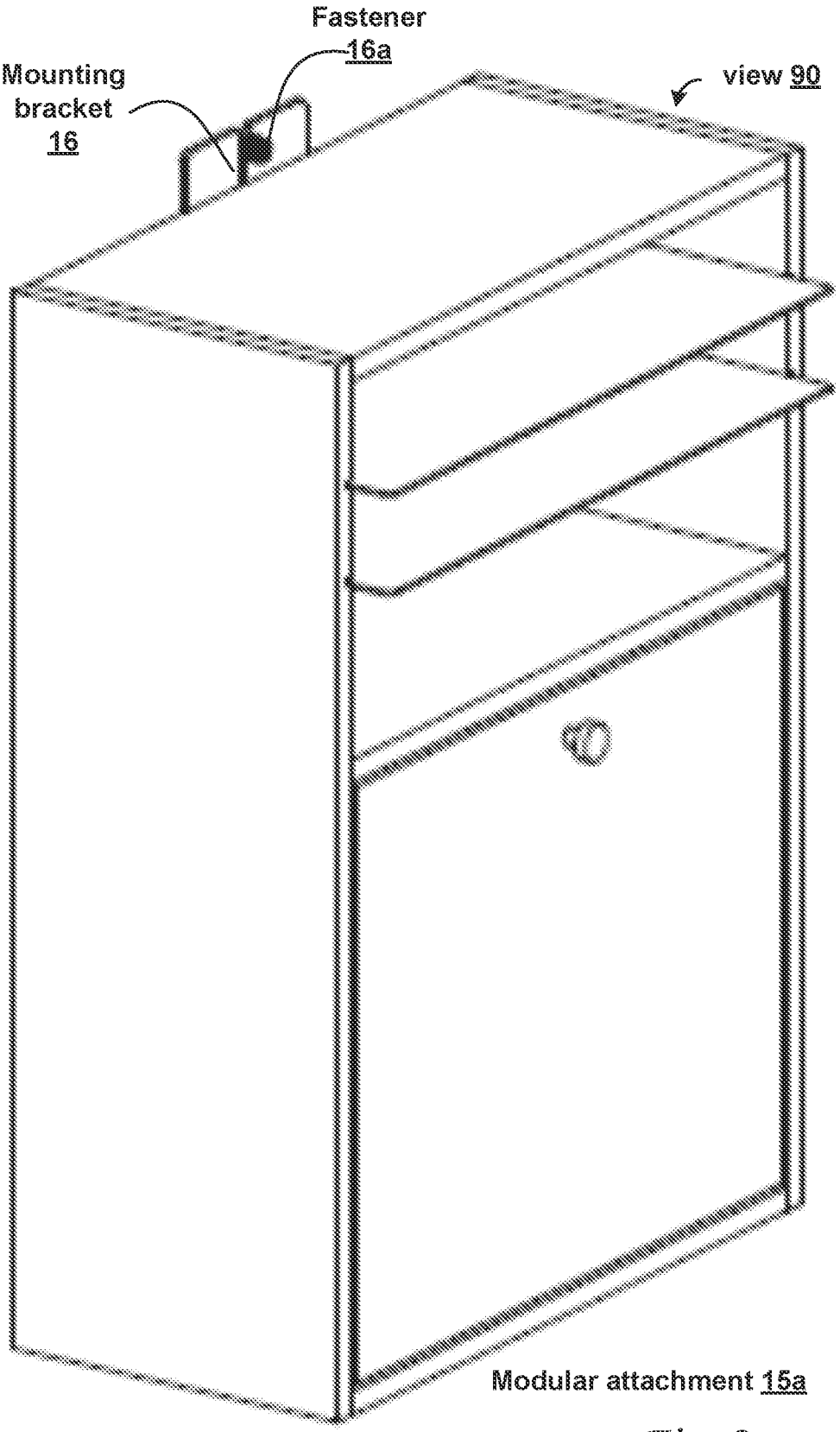
FIG. 9 shows a view of a modular attachment configured to be attached to a desk, in accordance with one or more implementations.

FIG. 8 depicts a different modular attachment than shown in FIG. 6 (here, desk 100 in FIG. 8 includes modular attachment 15*a*, which may be both a storage unit and a shelving unit combined) as being coupled on the outside of right-side support structure 22, in a similar manner as the coupling described for FIG. 6 (i.e., using one or more mounting brackets to mechanically couple modular attachment 15*a* to right-side support structure 22). FIG. 9 shows a view 90 of modular attachment 15*a*, including a mounting bracket 16, fastener 16*a*, and/or other components. FIG. 8 depicts modular attachment 15*a* as being coupled on the outside of right-side support structure 22. However, this is exemplary and not intended to be limiting. In some implementations, modular attachment 15*a* may be coupled on the inside of right-side support structure 22. In other implementations, modular attachment 15*a* may be coupled on the outside of left-side support structure 24 (e.g., by using one or both of left-side attachment screw holes 24*f*). In other implementations, modular attachment 15*a* may be coupled on the inside of left-side support structure 24.

Referring to FIG. 1A, right-side support structure 22 may be disposed at a right side of desk 100 with respect to work surface 3 of working body 2. In some implementations, right-side support structure 22 may be stationary during adjustments of the current height of work surface 3. FIG. 4A shows an outside view 400A of right-side support structure 22. FIG. 4B shows an inside view 400B of right-side support structure 22. In some implementations right-side support structure 22 may include right-sided back opening 22*a* and right-sided front opening 22*c* in front of right-sided back opening 22*a*.

Right-sided back opening 22*a* of right-side support structure 22 may be configured to include a first width at least as wide as a back-panel thickness 12*k* (FIG. 3D) and a first height at least as long as a back-panel height 12*y* (FIG. 3D). In some implementations, right-side support structure 22 may be configured to include a right-sided stile 22*b*, disposed between right-sided back opening 22*a* and right-sided front opening 22*c*. Right-sided stile 22*b* may be configured to have a width less than a distance between back-panel front side 12*x* (FIG. 3C) and front-panel rear side 12*f* (FIG. 3C). By way of non-limiting example, right-sided stile 22*b* of right-side support structure 22 may be identified as one or more of a right-sided post, a right-sided connector, a right-sided closing, a right-sided panel, a right-sided member, and/or other terms that properly identify 22*b*.

In some implementations, right-side support structure 22 may be configured to include right-sided front opening 22*c* comprised of a width and a height. The width of right-sided front opening 22*c* may be in the range of 80%-95% of a width of right-side support structure 22. In some implementations, the width of right-sided front opening 22*c* may be in the range of 70%-85% of a width of right-side support structure 22. In some implementations, the width of right-sided front opening 22*c* may be in the range of 60%-80% of a width of right-side support structure 22, as depicted in FIG. 4C. In some implementations, the height of right-sided front opening 22*c* may be in the range of 80%-95% of a height of right-side support structure 22. In some implementations, the height of right-sided front opening 22*c* may be in the range of 70%-85% of a height of right-side support structure 22. In some implementations, the height of right-sided front opening 22*c* may be in the range of 60%-80% of a height of right-side support structure 22, as depicted in FIG. 4C. In some implementations, the width of right-sided front opening 22*c* may range between 14 and 17 inches, or between 15 and 20 inches. For example, the width of right-sided front opening 22*c* may be about 15 inches. In some implementations, the height of right-sided front opening 2*sc* may range between 18 and 23 inches, or between 20 and 25 inches. For example, the height of right-sided front opening 2*sc* may be about 21 inches.

In some implementations, a shape of the right-side support structure 22 as viewed from the right side of desk 100 may be a rectangular shape. By way of non-limiting illustration, the shape of the right-side support structure 22 as viewed from the right side of desk 100 may be one or more of a circle, triangle, and/or other geometric shapes. It is noted that a difference in the shape of the right-side support structure as viewed from the right side may change many other components of desk 100. In implementations where a side support structure would have a different shape than depicted, the same manner of coupling components together would be retained so that working body 2 would be lifted and/or lowered by lifting mechanisms positioned at its rear and having support structures on the side of desk 100.

In some implementations, right-side support structure 22 and left-side support structure 24 may have attachment screw holes as shown by 22*f* (FIG. 4B, 400B) and 24*f* (FIG. 4D, 400D) configured to support the coupling of interchangeable modular desk attachments. By way of non-limiting example, the modular attachments may be one or more of extra storage, shelves, waste receptacles, file organizers, water coolers, plant holders, desk extension platforms, pet bed attachment, pet entertainment attachment, and/or other functional attachments (as well as combinations thereof) to further customize the desk to satisfy a user's desires (and/or the pet's desires).

In some implementations, right-side support structure 22 and left-side support structure 24 may fully support working body 2 and core body 10. In some implementations, each support structure may have one point of contact with the ground. In some implementations, each support structure may have at least two points of contact with the ground. By way of non-limiting example, there may be one or more left-sided support structure points of contact with ground 24*e* (FIG. 4C). Similarly, there may be one or more right-sided support structure points of contact with ground 22*e* (FIG. 4A). In some implementations, by virtue of left-side support structure 22 and right-side support structure 24 fully supporting working body 2 and core body 10, working body 2 and core body 10 do not contact the ground directly.

Figure 5A:
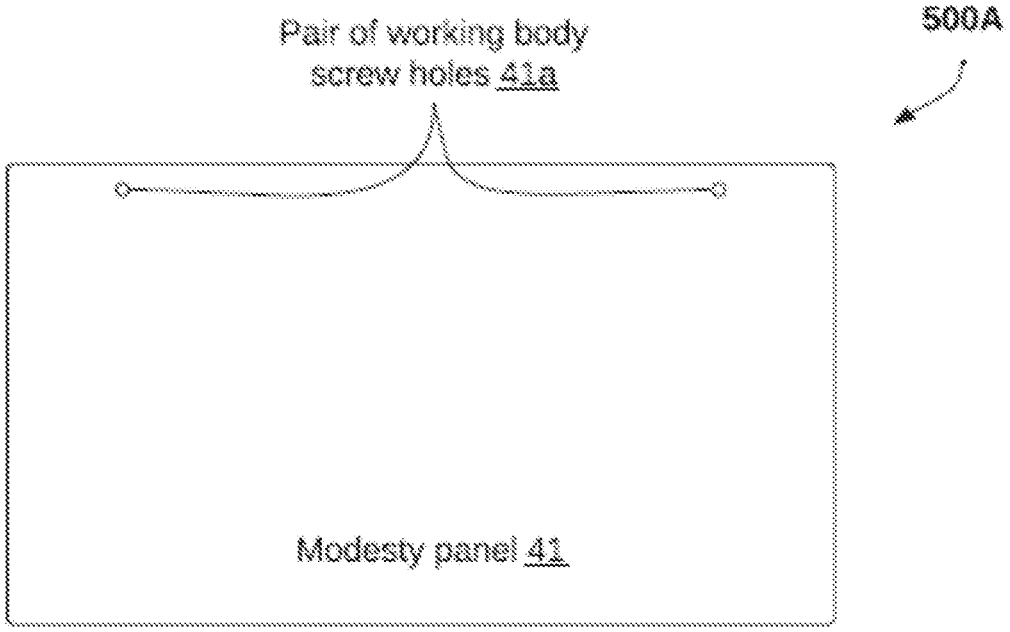
FIG. 5A shows a front view 500A of a modesty panel, in accordance with one or more implementations.
Figure 5B:
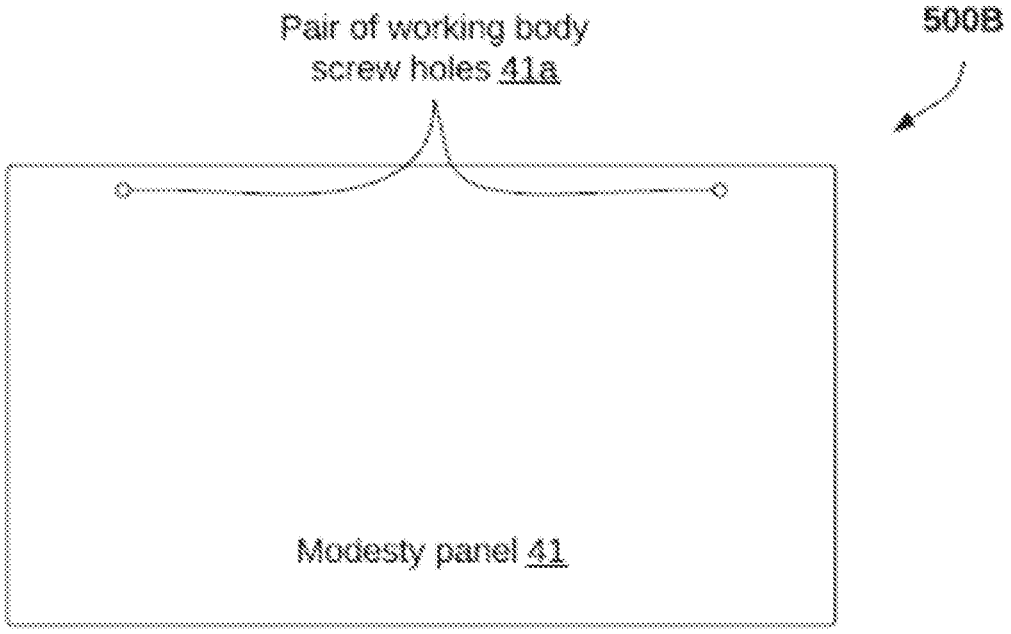
FIG. 5B shows a rear view 500B of a modesty panel, in accordance with one or more implementations.

FIG. 5A shows a front view 500A of a modesty panel 41. FIG. 5B shows a rear view 500B of modesty panel 41. In some implementations, modesty panel 41 may include a pair working body screw holes 41*a*, and/or other components. Pair of working body screw holes 41*a* may facilitate convenient coupling of modesty panel 41 to working body 2 by virtue of one or more screws, nuts, bolts, pins, and/or one or more other fastening hardware or fasteners to secure/fasten objects together. Modesty panel 41 may be configured to move with working body 2 as it is lifted and/or lowered.

Figure 11A:
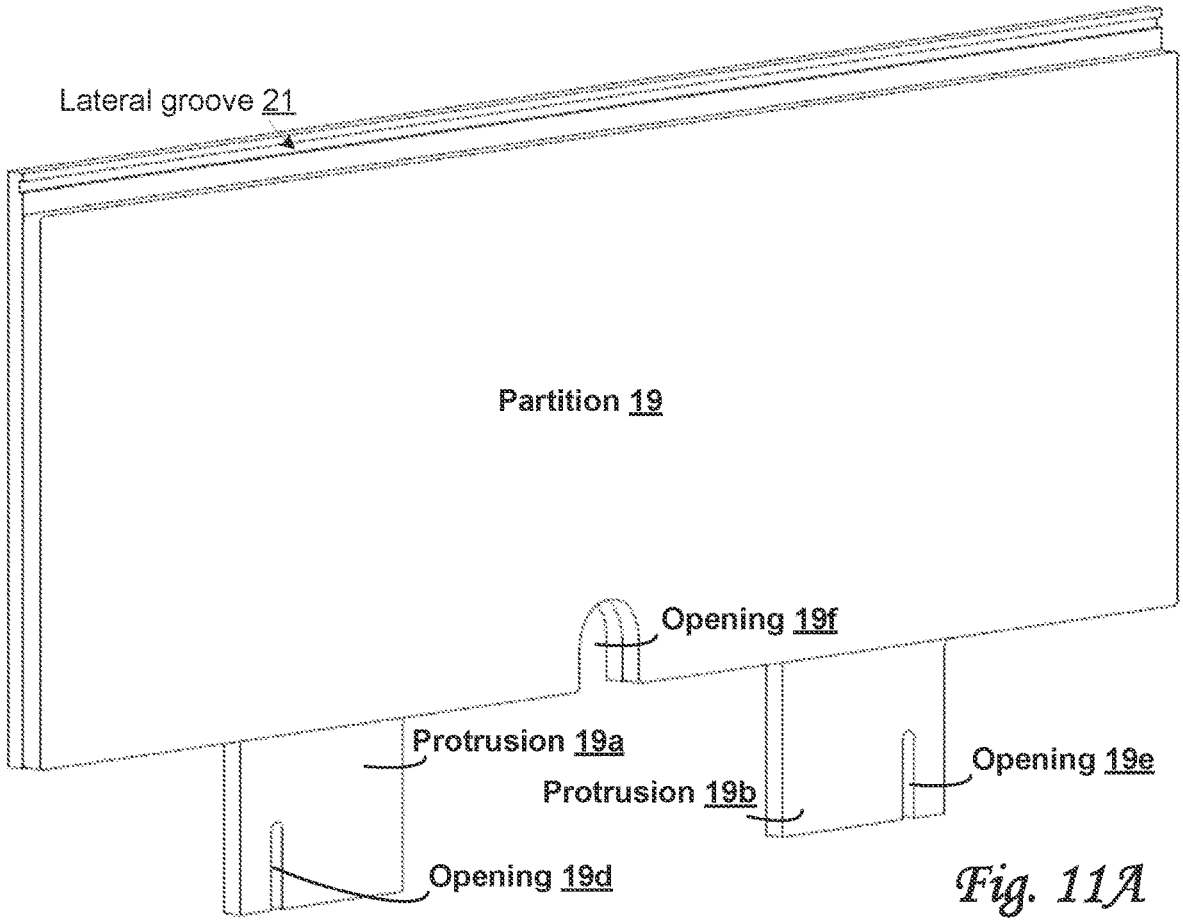
FIGS. 11A-11B-11C show an upright partition for use with a desk, the upright partition configured to support laterally-movable attachments, in accordance with one or more implementations.
Figure 11B:
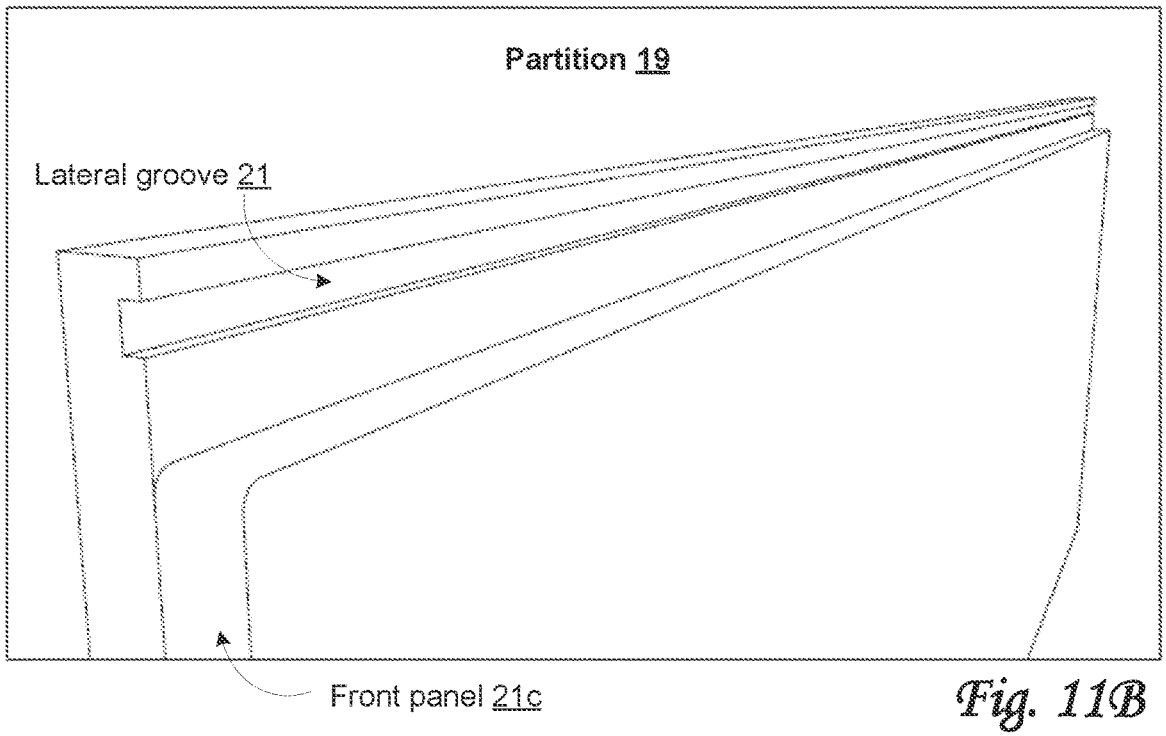
Figure 11C:
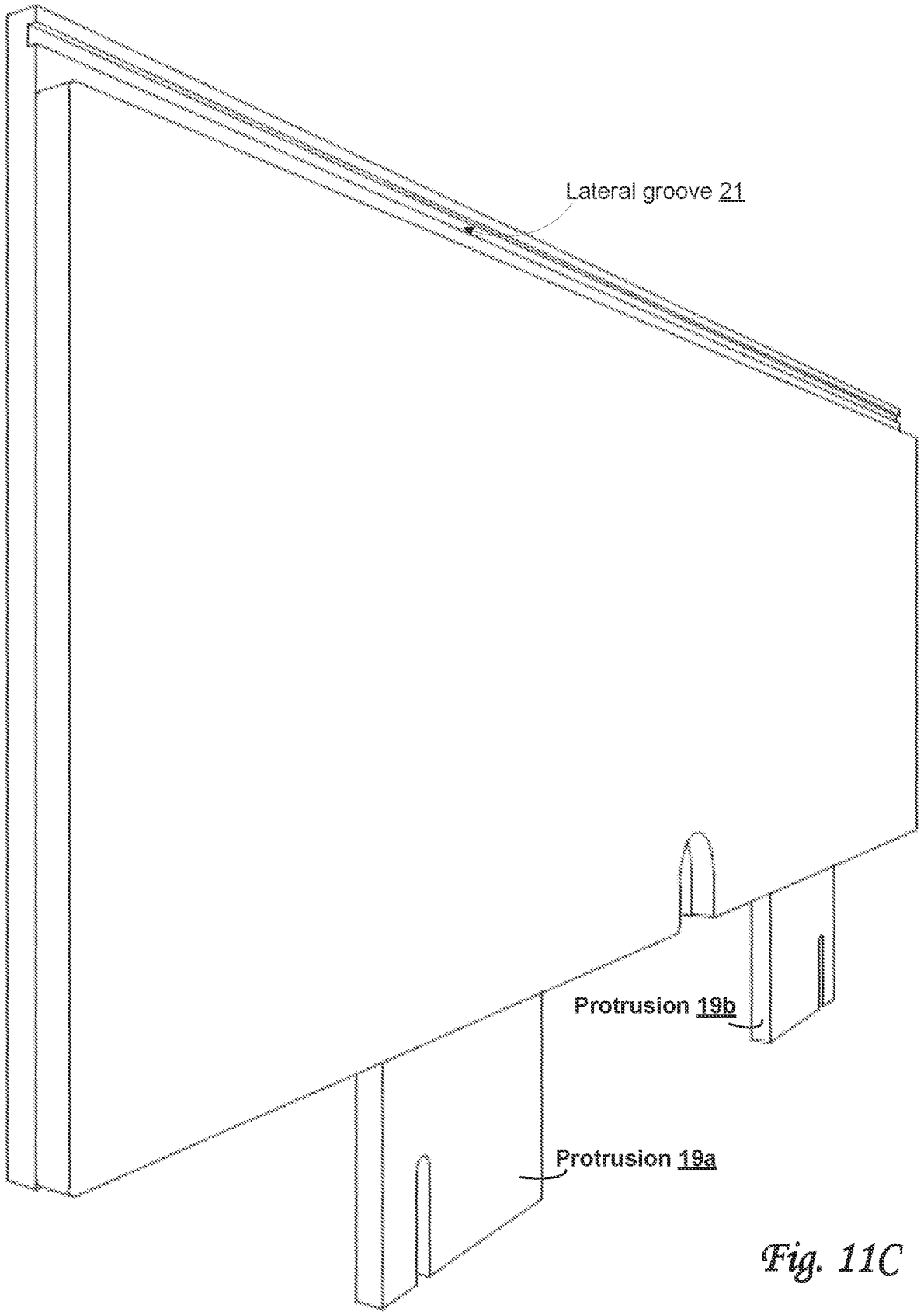

FIGS. 11A-11B-11C show upright partition 19 for use with desk 100, upright partition 19 being configured to support laterally-movable attachments. FIG. 11A illustrates upright partition 19 including first protrusion 19*a*, second protrusion 19*b*, lateral groove 21, a front panel 21*c*, and/or other components or elements. The cross section of lateral groove 21 may be rectangular, as depicted in FIG. 11B. Front panel 21*c* may be coupled and/or mounted to upright partition 19, e.g., such that notes, photographs, tacks and such may be affixed to front panel 21*c*. In some implementations, upright partition 19 may include an opening 19*f* configured for cable management. In some implementations, individual protrusions may include one or more openings (e.g., one or more slits) configured for coupling upright partition 19 to desk 100 (e.g., to working body 2). For example, first protrusion 19*a* may include first opening 19*d*. For example, second protrusion 19*b* may include second opening 19*e*. FIG. 11C illustrates upright partition 19 at a different viewing angle than FIG. 11A.

Figure 12A:
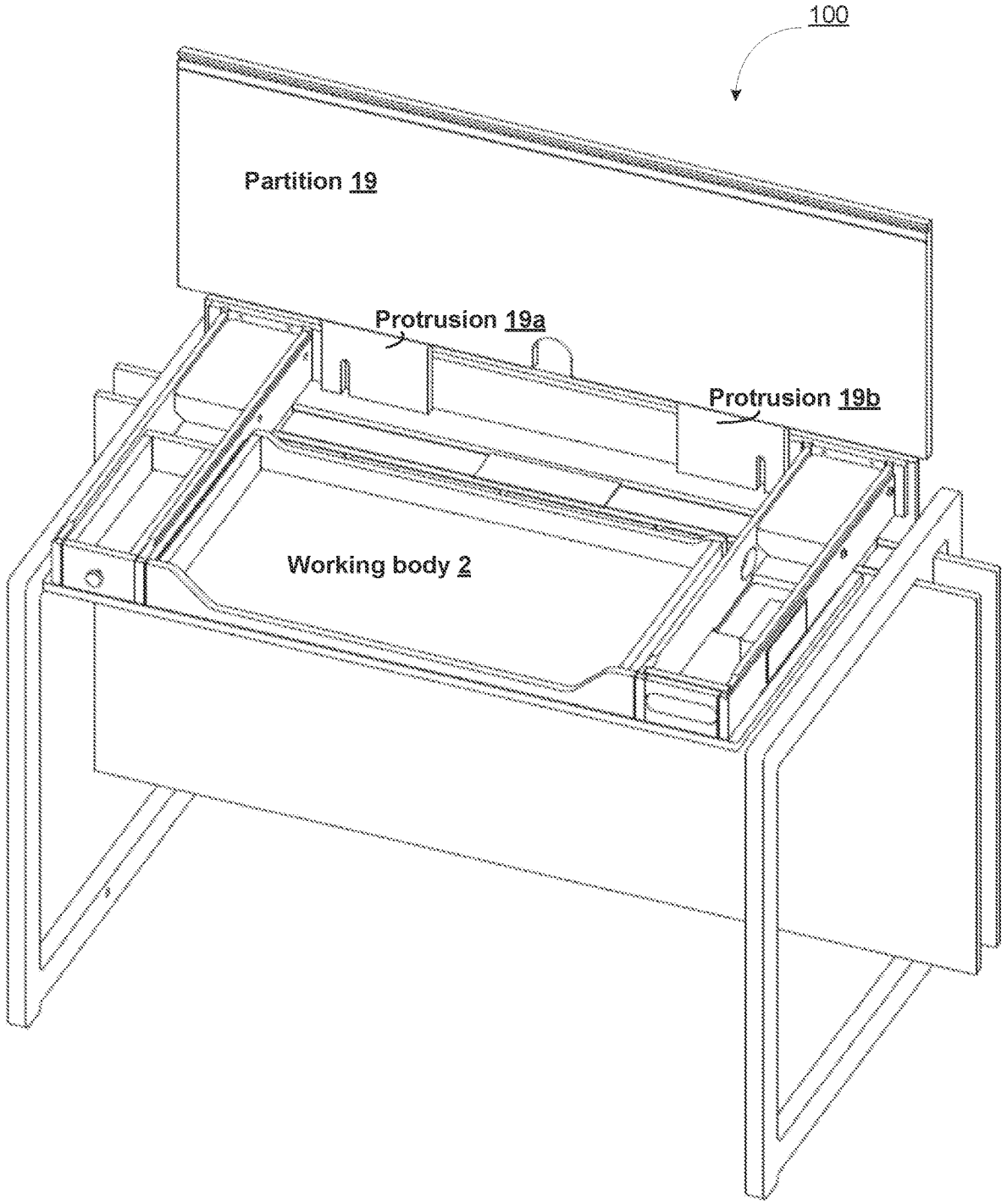
FIG. 12A shows a partially assembled desk with an upright partition that supports laterally-movable attachments, in accordance with one or more implementations.
Figure 12B:
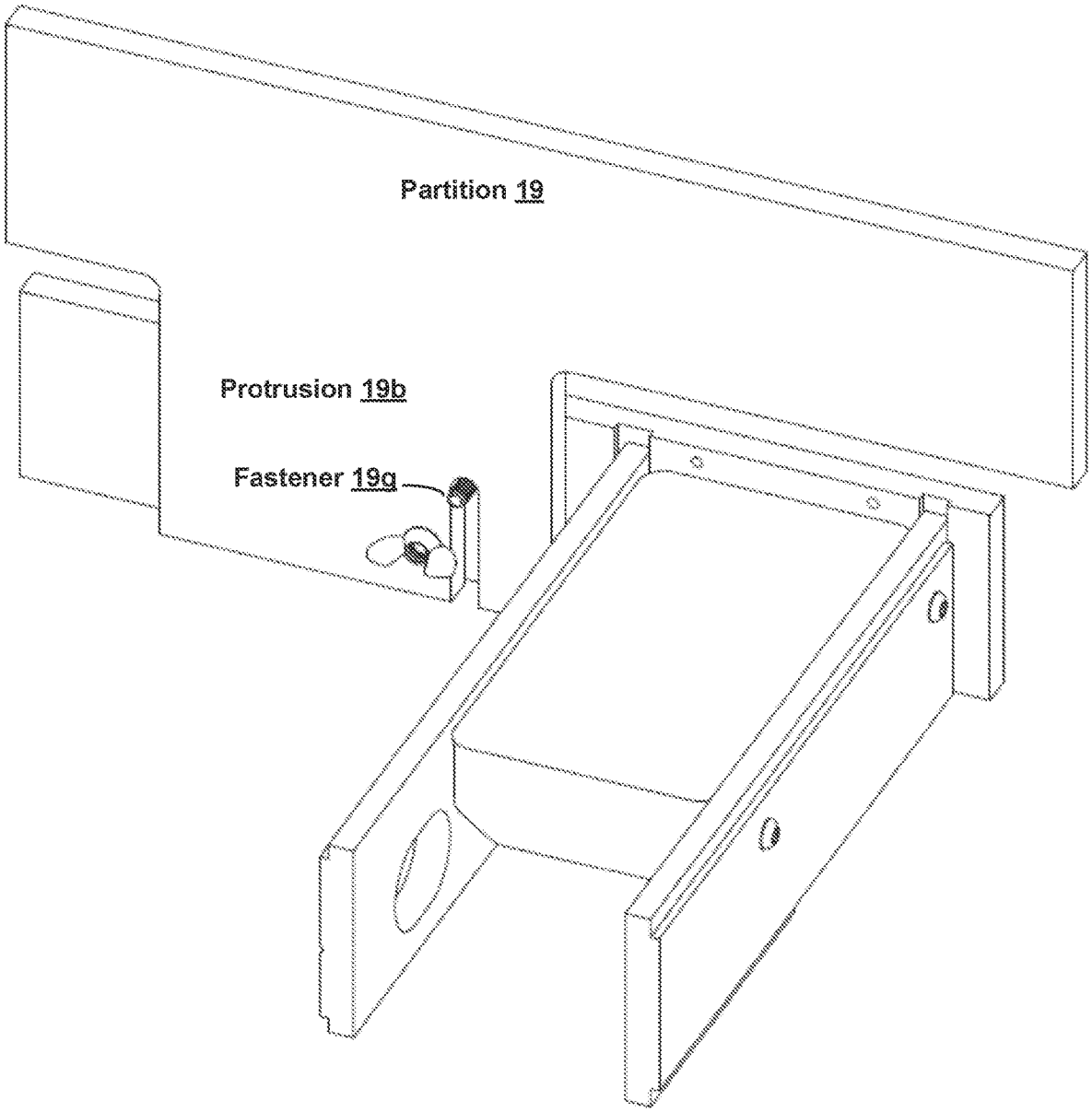
FIG. 12B shows a detailed view of a section or fraction of a desk with an upright partition that supports laterally-movable attachments, in accordance with one or more implementations.

FIG. 12A shows a partially assembled desk 100 with upright partition 19 that supports laterally-movable attachments. In particular, FIG. 12 illustrates how first protrusion 19*a* and second protrusion 19*b* are inserted into working body 2 during assembly. FIG. 12B shows a detailed view of a section or fraction of desk 100. In particular, FIG. 12B illustrates a portion of partition 19 that includes second protrusion 19*b*, which may be secured by a fastener 19*g* (e.g., including a thumbscrew or wingnut as depicted).

Figure 13A:
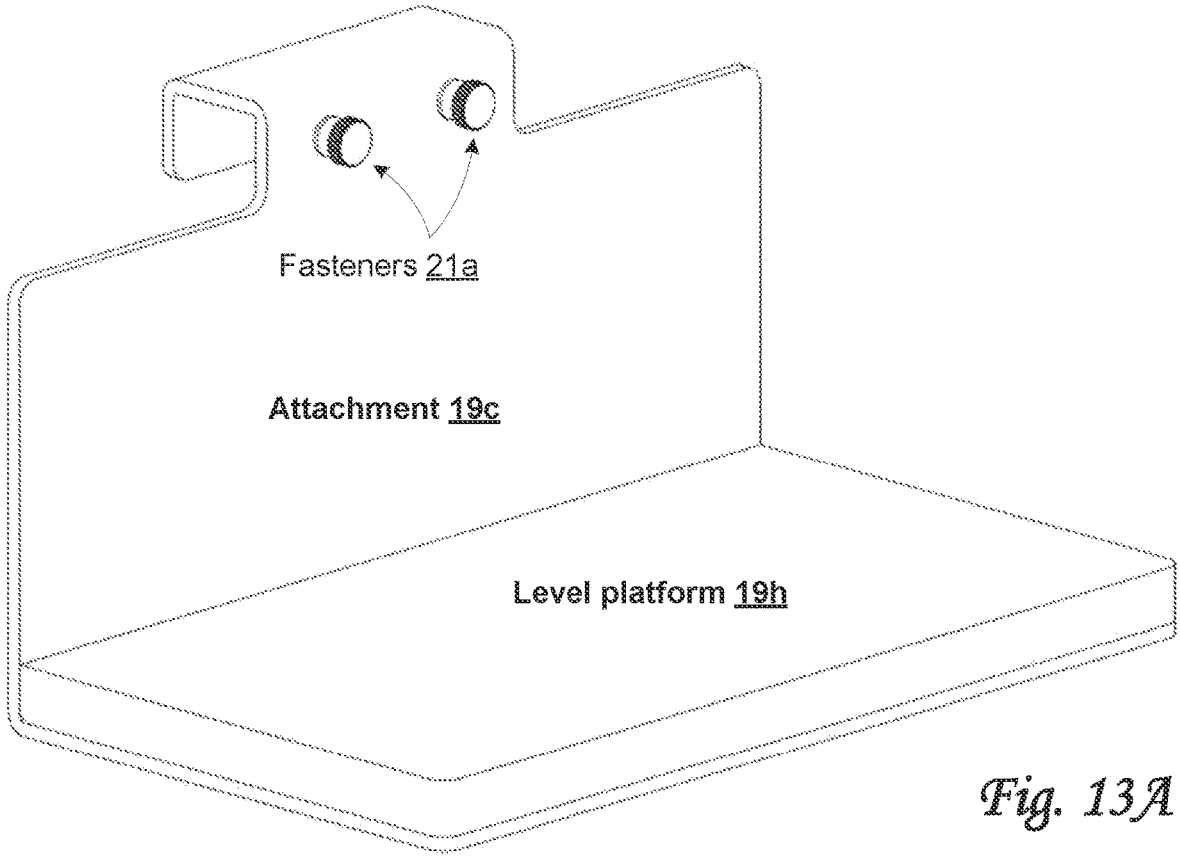
FIGS. 13A-13B show a laterally-movable attachment for use with a desk with an upright partition that supports laterally-movable attachments, in accordance with one or more implementations.
Figure 13B:
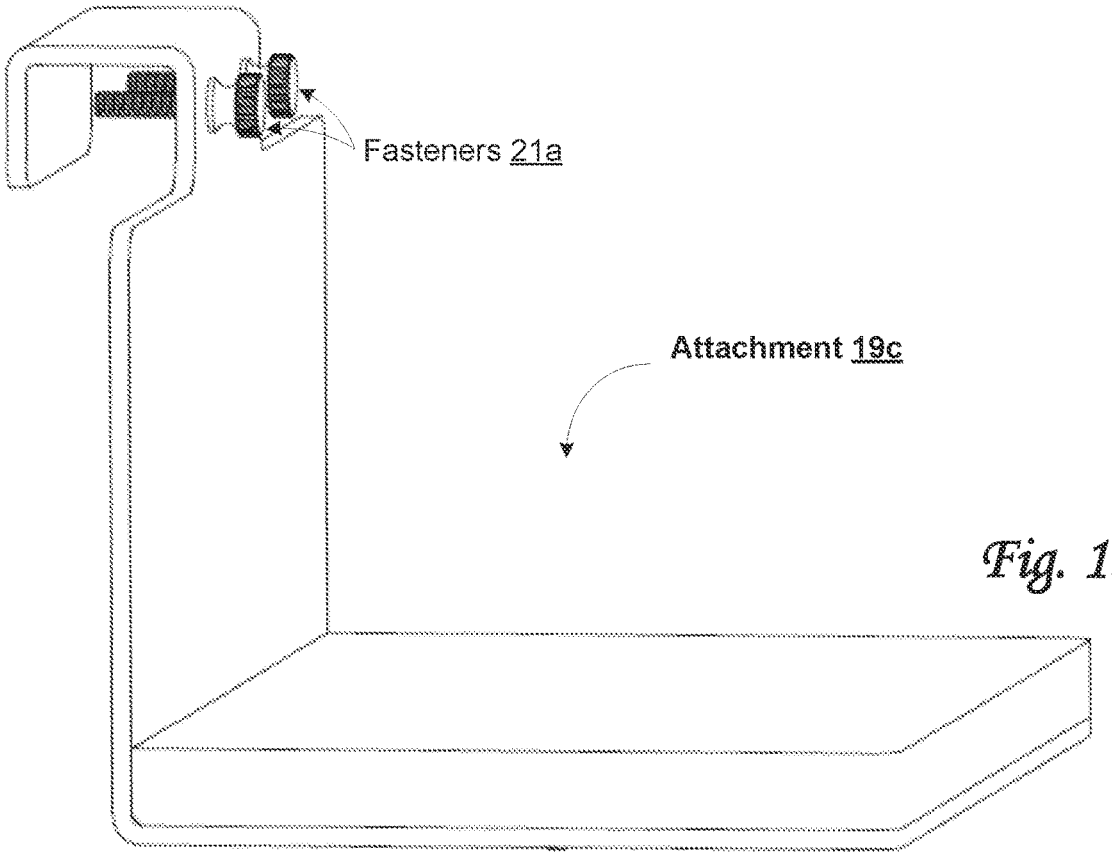

FIGS. 13A-13B show different angles for laterally-movable attachment 19*c* (e.g., a small shelf) for use with desk 100 with upright partition 19 that supports laterally-movable attachments. Laterally-movable attachment 19*c* may include one or more fasteners 21*a* as depicted. In some implementations, laterally-movable attachment 19*c* may include a single element of bent and/or curved metal configured to support a level platform 19*h* that serves as a shelf for the user of the desk.

Figure 14A:
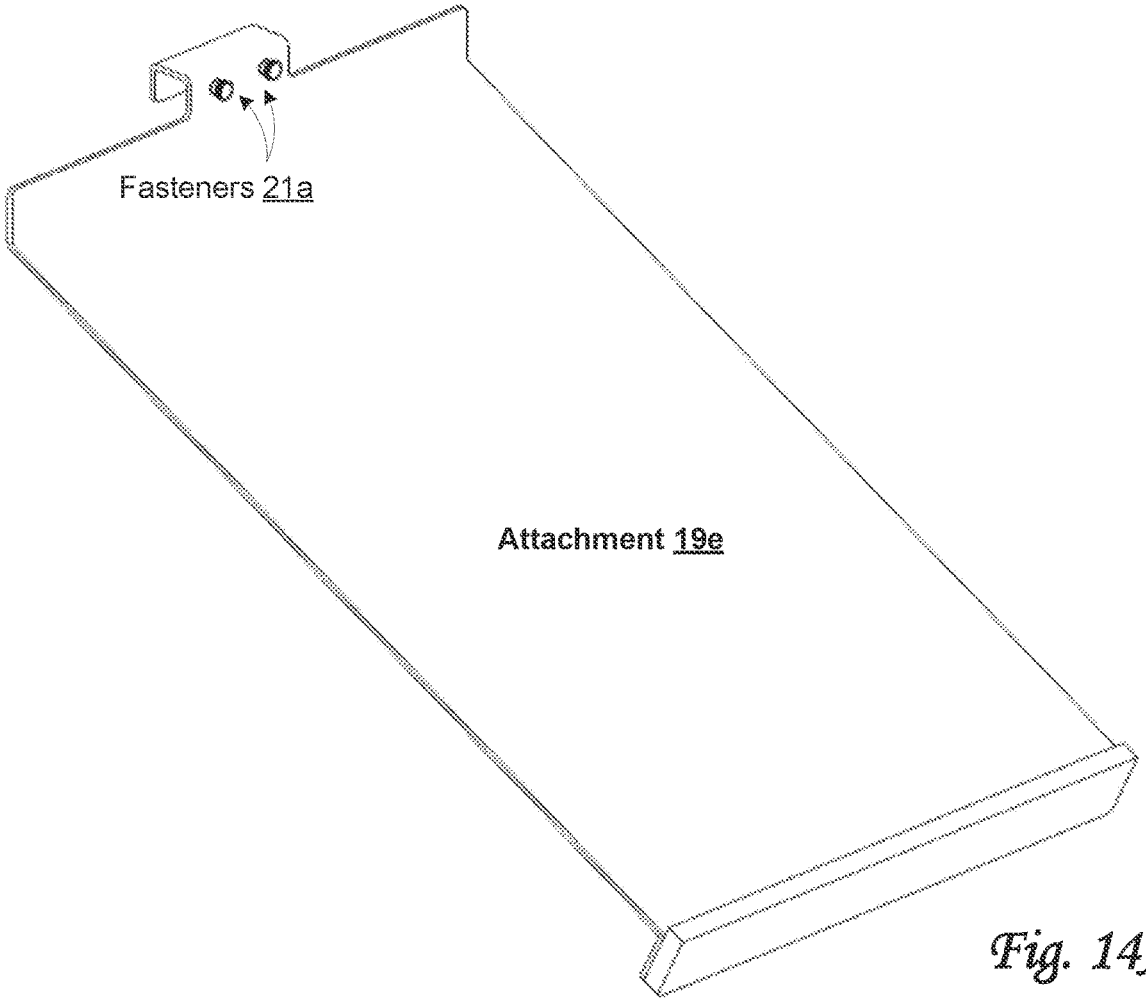
FIGS. 14A-14B show a different laterally-movable attachment for use with a desk with an upright partition that supports laterally-movable attachments, in accordance with one or more implementations.
Figure 14B:
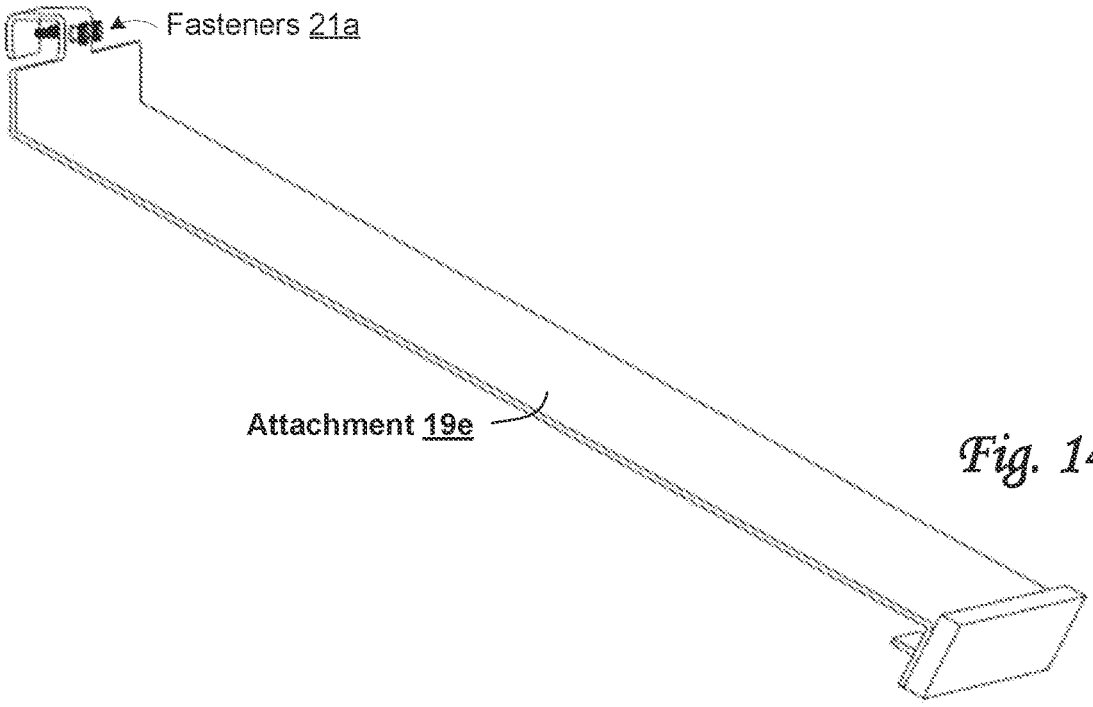

FIGS. 14A-14B show different angles for laterally-movable attachment 19*e* (e.g., a diagonal support) for use with desk 100 with upright partition 19 that supports laterally-movable attachments. Laterally-movable attachment 19*e* may include one or more fasteners 21*a* as depicted.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A desk configured to support laterally-movable attachments including a first laterally-movable attachment, the desk having a left side, a right side, a rear side, and a front side as viewed by a user, wherein the desk comprises:

a work surface of the desk, wherein the work surface is disposed at a current height;

a left-side support structure disposed at the left side of the desk with respect to the work surface of the desk, wherein the left-side support structure supports at least part of the desk;

a right-side support structure disposed at the right side of the desk with respect to the work surface of the desk, wherein the right-side support structure supports at least part of the desk;

a working body that provides the work surface of the desk, wherein the working body includes one or more slots at the rear side of the work surface;

an upright partition having a top side and a bottom side, wherein the upright partition is configured to be coupled to the working body, wherein the upright partition is planar in a vertical plane, wherein the upright partition includes one or more protrusions at the bottom side of the upright partition, wherein the one or more protrusions are co-planar in the vertical plane of the upright partition, wherein individual ones of the one or more protrusions are configured to fit into individual ones of the one or more vertical slots of the working body such that the one or more slots securely hold the one or more protrusions, wherein the upright partition includes a lateral groove that, upon coupling of the upright partition to the working body, extends laterally between the left side and the right side of the upright partition and that guides lateral movement of the laterally-movable attachments; and the first laterally-movable attachment configured to mechanically couple to the upright partition by engagement with the lateral groove, and further such that the first laterally-movable attachment is configured to move laterally along the lateral groove.

2. The desk of claim 1, wherein the individual ones of the one or more protrusions include one or more openings configured for coupling, by one or more fasteners, the upright partition to the working body.

3. The desk of claim 1, wherein the one or more fasteners are configured to apply compressive force in a direction perpendicular to the vertical plane of the upright partition.

4. The desk of claim 1, wherein the first laterally-movable attachment is configured to provide extended functionality to the user of the desk, wherein the first laterally-movable attachment for the desk includes one or more of a shelf, a drafting table, and a lamp.

5. The desk of claim 1, wherein the desk further includes a core body disposed vertically at the rear side of the desk with respect to the work surface of the desk, wherein the core body extends laterally between the left side and the right side of the desk, wherein the core body is coupled to the left-side support structure and coupled to the right-side support structure.

6. The desk of claim 5, wherein the current height at which the work surface is disposed is adjustable, wherein the left-side support structure is stationary during adjustments of the current height of the work surface, wherein the right-side support structure is stationary during the adjustments of the current height of the work surface, wherein the core body houses a first lifting mechanism and a second lifting mechanism, wherein the core body is stationary during the adjustments of the current height of the work surface except for the first and second lifting mechanism, wherein the working body is configured to adjustably couple to the first and second lifting mechanisms, wherein the desk further comprises:

a control interface configured to receive user input from the user; and control circuitry configured to:

(i) detect the user input received by the control interface;

(ii) responsive to detection of the user input, control the first and second lifting mechanisms to either (a) lift the working body, including the upright partition, and increase the current height of the work surface, or (b) lower the working body, including the upright partition, and decrease the current height of the work surface.

7. The desk of claim 6, wherein the first lifting mechanism includes a first mechanical linear actuator, wherein the second lifting mechanism includes a second mechanical linear actuator, and wherein controlling the first and second lifting mechanisms includes controlling the first mechanical linear actuator and the second mechanical linear actuator in synchrony.

8. The desk of claim 7, wherein the first lifting mechanism further includes a first motor, wherein the second lifting mechanism further includes a second motor, wherein the working body includes a first housing configured to house the first motor, and wherein the working body includes a second housing configured to house the second motor.

9. The desk of claim 5, wherein the left-side support structure and the right-side support structure fully support the working body and the core body, wherein each support structure has at least 2 points of contact with the ground, wherein the working body and the core body do not contact the ground directly.

* * * * *